US006216843B1

(12) United States Patent
Furuya

(10) Patent No.: US 6,216,843 B1
(45) Date of Patent: Apr. 17, 2001

(54) APPARATUS FOR TAKING OUT INFORMATION USING MAGNETIC SENSOR AND CARRYING OUT TEST OF ARTICLE BY USING THAT INFORMATION

(75) Inventor: Yonezo Furuya, Hatoyama-machi (JP)

(73) Assignee: Nippon Conlux Co., Ltd., Tokyo (JP)

( * ) Notice: Subject to any disclaimer, the term of this patent is extended or adjusted under 35 U.S.C. 154(b) by 0 days.

(21) Appl. No.: 09/088,201

(22) Filed: Jun. 1, 1998

(30) Foreign Application Priority Data

| | | |
|---|---|---|
| Jun. 5, 1997 | (JP) | 9-147808 |
| Jun. 5, 1997 | (JP) | 9-147812 |
| Jun. 18, 1997 | (JP) | 9-160924 |
| Jul. 14, 1997 | (JP) | 9-188674 |

(51) Int. Cl.[7] ..... G07D 7/04
(52) U.S. Cl. ..... 194/206
(58) Field of Search ..... 194/206, 207; 209/534; 382/135

(56) References Cited

U.S. PATENT DOCUMENTS

| | | | | |
|---|---|---|---|---|
| 3,643,155 | * | 2/1972 | Riddle et al. | 324/254 |
| 4,749,087 | | 6/1988 | Buttifant | 209/534 |
| 4,864,238 | | 9/1989 | Seitz | 194/317 X |
| 4,995,497 | | 2/1991 | Kai et al. | 194/318 |
| 5,495,929 | * | 3/1996 | Bataliantes et al. | 194/207 |
| 5,612,528 | | 3/1997 | Green et al. . | |

FOREIGN PATENT DOCUMENTS

| | | |
|---|---|---|
| 0392110 | 10/1990 | (EP) . |
| 0780837 | 6/1997 | (EP) . |

* cited by examiner

*Primary Examiner*—F. J. Bartuska
(74) *Attorney, Agent, or Firm*—Hogan & Hartson, LLP.

(57) ABSTRACT

An apparatus adapted for testing, in a non-contact manner, true/false property of bill, coin or magnetic card to be tested, comprises a non-contact type magnetic sensor 1 disposed, at a predetermined position of a carrying passage of the bill, in a manner close to the carrying path, and a testing circuit 2 for testing true/false property of the bill on the basis of a signal outputted from the magnetic sensor according as the bill is carried along the carrying passage. This testing apparatus permits improvement in the security and prevention of wear of bill and the apparatus itself.

4 Claims, 26 Drawing Sheets

APPARATUS FOR TAKING OUT INFORMATION USING MAGNETIC SENSOR AND CARRYING OUT TEST OF ARTICLE BY USING THAT INFORMATION

BACKGROUND OF THE INVENTION

This invention relates to a method and an apparatus for testing true/false property of various cards such as bill, coin, ID card, credit card, bank card, check card and composite card, etc., and card or the like on which information is recorded such as passenger ticket, etc., and more particularly to a true/false testing method for bill to be tested and a true/false testing apparatus for bill to be tested so as to have ability of testing, in a non-contact manner, bill to be tested printed by magnetic ink.

PRIOR ART

In recent years, with popularization of the automatic vending machine, etc., there is no end to mischief to deceive unit such as bill discriminator, etc. to snatch change within the unit, etc. Moreover, crimes by forgery of bill are being increased. Further, there are being increased the cases where foreign bills are taken in from various foreign countries followed by internalization, and those foreign bills are intentionally or erroneously used in the automatic vendering machine, etc.

From such situations, a measure by realization of high level printing of bill is taken and improvement in the security and testing technology of high accuracy are required for the unit.

As one of realization of high level printing of bill, a method using magnetic ink is known. For example, there is one dollar bill of U.S.A., etc. printed by magnetic ink. In the case of this one dollar bill, the strength of residual magnetism in space spaced by about 1 mm from the surface thereof is about 10–4 Oe (Oersted) to 10–3 Oe (Oersted). This corresponds to intensity (strength) of 1/100 to 1/1000 of ground magnetism.

In the unit of the prior art, a method using magnetic head is typical as a method of detecting magnetic ink. Further, in the magnetic head of the conventional unit, coil type magnetic head adapted so that coil is wound on magnetic pole by magnetic material, and MR element type magnetic head using magnetic resistance (MR) element, etc. are used. Even magnetic head of the MR element type of relatively high sensitivity among these both magnetic heads has its sensitivity of about $10^{-2}$ Oe (Oersted).

As stated above, in the conventional bill discriminating machine, because the sensitivity of the magnetic head is low, it was required for detecting magnetism of the magnetic ink portion of the bill surface to carry out scanning while allowing the magnetic head to be in contact with the printing portion of magnetic ink. As a result, since stripe when the magnetic head portion is scanned is left on the surface of the bill, which portion of bill is detected by the unit becomes clear. This is suitable target for person who tries to intentionally carry out mischief, and there is the problem in the security serving as clue to deceive the unit or the like.

On the other hand, since bill is carried in the state where it is put between the magnetic head and the roller as described above, there was also the problem that bill is easy to be clogged at the magnetic head portion of the carrying path. Further, since bill is carried in the state in contact with the magnetic head portion, there were problems that mechanical abrasion of the magnetic head takes place, and life time of the magnetic head is shortened and life time of the bill is shortened. In addition, since scanning is carried out in the state where the magnetic head and the roller are caused to be in contact with the bill, there took place the problem that dust is apt to be attached to the magnetic head, and a predetermined signal cannot be obtained in the remarkable case.

In view of the above, as a way of use of the magnetic head of the conventional type, the magnetic head is caused to be in contact with the magnetic ink portion printed on the bill surface to carry out scanning in such a manner that the bill is put between the magnetic head and the roller in order to further ensure contact between the bill and the magnetic head to carry out test from signal obtained at that time whether or not bill to be tested is true.

Moreover, in the case of testing the coin, as true/false test of coin, many kinds of methods are proposed as compared to the bill. There are, e.g., a method in which coin dimension such as diameter or thickness, etc. is caused to be reference, a method in which hole with respect to the coin having hole is caused to be reference, a method in which notches of outer circumference are caused to be reference, a method in which projected edge with respect to coin provided with projected edge is caused to be reference, and a method in which coin material property such as weight, sound, mechanical repulsive property, or electromagnetic absorption, etc. is caused to be reference, etc. This is because, in the case of coin, there are many kinds of coins in both shape and material entirely unlike money in which shape and material are substantially fixed such as bill.

In this case, when consideration is made in connection with the automatic vending machine in which it is common to provide true/false testing means for coin, it is necessary that both bill and coin can be similarly tested. In view of the above, even in test of coin, it is desirable to adopt testing technique of bill even if any method can be utilized in addition to the testing technique of coin.

SUMMARY OF THE INVENTION

In view of the above, an object of this invention is to provide a true/false property testing method for bill to be tested and a true/false property testing apparatus for bill to be tested capable of testing, in a non-contact manner, true/false property of bill to be tested in order to improve the security and to prevent wear of bill and testing apparatus.

Moreover, an object of this invention is to provide a reading method and a reading apparatus for magnetic card or the like capable of improving the security and preventing wear of the magnetic card or the like, thus making it possible to read, in non-contact manner, recording information of magnetic card or the like Further, an object of this invention is to provide a true/false property testing method for coin and a true/false property testing apparatus for coin capable of carrying out, with high accuracy, true/false test of coin by magnetic detecting means.

In order to attain the above-described objects, this invention is characterized in that, in a method of testing, in a non-contact manner, true/false property of bill to be tested, a non-contact type magnetic sensor is disposed, at a predetermined position of a carrying path of bill, in a manner close to the carrying path to test true/false property of the bill on the basis of a signal outputted from the magnetic sensor according as the bill is carried along the carrying path.

Moreover, in accordance with this invention, in an apparatus for testing, in a non-contact manner, true/false property of bill to be tested, there may be employed a configuration comprising a thin film flux gate type magnetic sensor disposed, at a predetermined position of a carrying path of the bill, in a manner close to the carrying path, and testing means for testing true/false property of the bill on the basis of a signal outputted from the magnetic sensor according as the bill is carried along the carrying path.

Further, in accordance with this invention, in a method of carrying out, in the middle of carrying of coin to be tested, magnetic detection from the coin while applying excitation magnetic field to the coin to test its true/false property, when the magnetic detection is carried out, a signal with respect to time change of circumferential magnetic flux produced by allowing high frequency current to flow in a magnetic line is taken out as change by the excitation magnetic field.

Further, in accordance with this invention, in a method of reading, by the non-contact system, information recorded while carrying magnetic card or the like for recording information by magnetism along a carrying path, a magnetic sensor is disposed, at a predetermined position of the carrying path of the magnetic card or the like, in a manner close to the carrying path to read information recorded on the magnetic card or the like on the basis of a signal outputted from the magnetic sensor according as the magnetic card or the like is carried along the carrying path.

In addition, the magnetic sensor may be constituted by a magnetic inductance type magnetic sensor for detecting voltage with respect to time change of circumferential magnetic flux produced by allowing current varying in point of time to flow in the magnetic line as change by externally applied magnetic field to read information recorded on bill, coin or magnetic card or the like to be tested on the basis of a signal outputted from the magnetic inductance type magnetic sensor.

DESCRIPTION OF THE PREFERRED EMBODIMENTS

Figure 1:
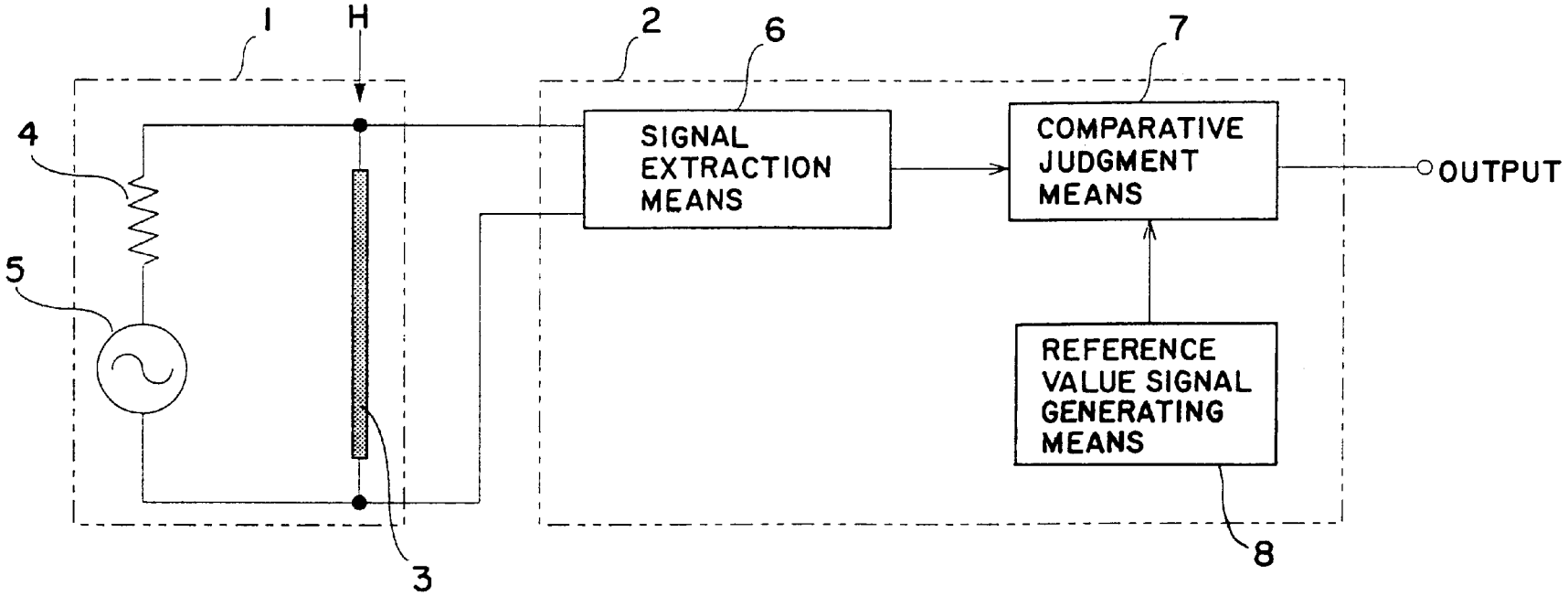
FIG. 1 is a block diagram showing an embodiment of a true/false property testing circuit for bill to be tested according to this invention.

FIG. 1 shows a testing circuit for testing bill and is a block diagram showing an embodiment of a true/false property testing circuit for bill to be tested according to this invention.

The true/false property testing circuit for bill is constituted by using computer in practice.

Figure 2:
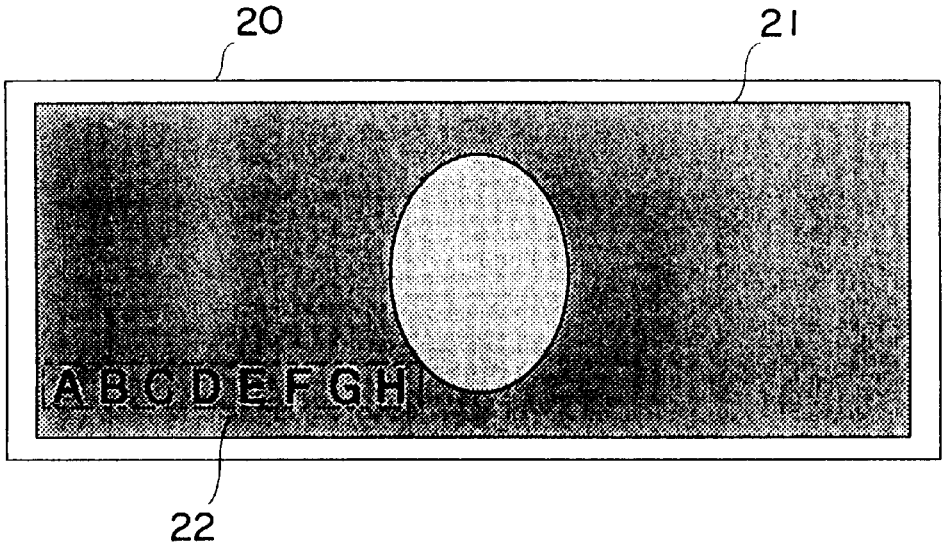
FIG. 2 is a view showing an example of the configuration of bill to be tested.

FIG. 2 shows an example of the configuration copying bill 20 to be tested used in the example of the configuration. In FIG. 2, a printing area 21 of the surface of the a bill 20 to be tested is adapted so that pattern/character, etc. are printed and includes a magnetic printing portion 22 printed by magnetic ink. At this magnetic printing portion 22, there exists residual magnetism brought about by magnetic powder within the magnetic ink. Further, intensity (strength) of residual magnetism of the magnetic printing portion 22 can be detected by the magnetic sensor.

Returning to FIG. 1 for a second time, a magnetic sensor 1 is constituted by the magnetic inductance type magnetic sensor. The principle of this magnetic inductance type magnetic sensor is known by the Japanese Patent Application Laid Open No. 176930/1994 and the Japanese Patent Application Laid Open No. 283344/1994. Namely, this magnetic inductance type magnetic sensor detects, as change by externally applied magnetic field, voltage with respect to time change of circumferential magnetic flux produced by allowing high frequency current to flow in the magnetic line to output it. The sensitivity of this magnetic inductance type magnetic sensor is very high, and sensitivity equal to the FG (flux gate) type magnetic sensor or more than that can be obtained.

Moreover, detection signal of the magnetic sensor 1 is delivered to testing means 2. The testing means 2 includes signal extraction means 6, comparative judgment means 7 and reference value signal generating means 8, and serves to form output signal corresponding to detection signal of the magnetic sensor 1.

Further, the magnetic inductance type magnetic sensor 1 can utilize impedance change with respect to the externally applied magnetic field. In the magnetic inductance type magnetic sensor having such features, utilization of very weak magnetic field measurement, etc. is proposed as high sensitivity magnetic sensor operative at a room temperature.

Figure 3A:
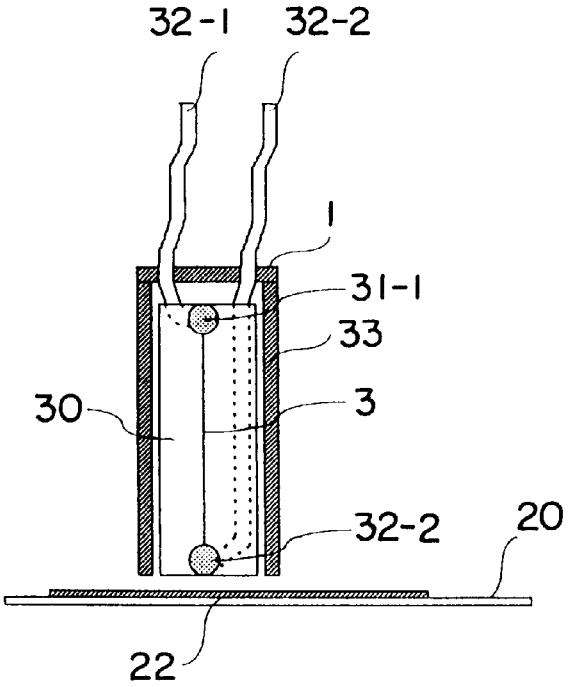
FIG. 3*a* is a view showing an example of the configuration of magnetic inductance type magnetic sensor used in the embodiment of FIG. 1.
Figure 3B:
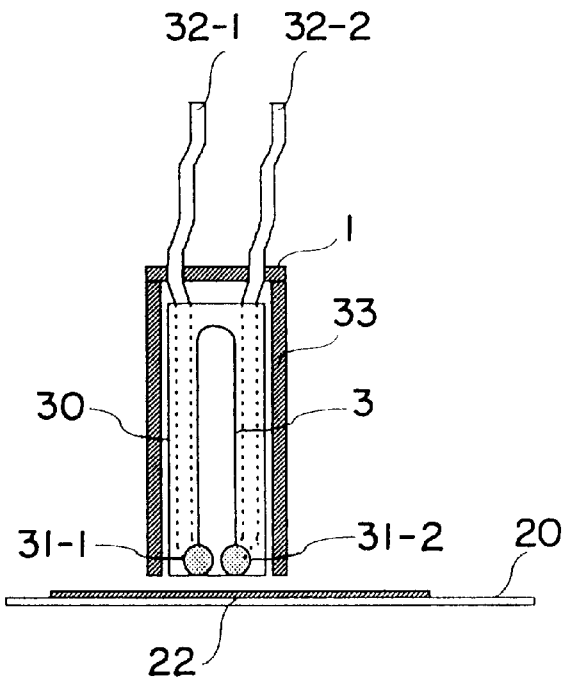
FIG. 3*b* is a view similarly showing another example of the configuration thereof.

FIGS. 3*a* and 3*b* show an example of the configuration of the magnetic inductance type magnetic sensor. In FIG. 3, a magnetic line 3 constitutes magnetic inductance element, and high permeability fine wire such as amorphous metal, etc. is used. The magnetic line 3 is bonded in a manner to electrically conduct terminals 31-1 and 31-2 provided at both ends of a printed board 30, and is connected to lead lines 32-1 and 32-2.

Figure 4:
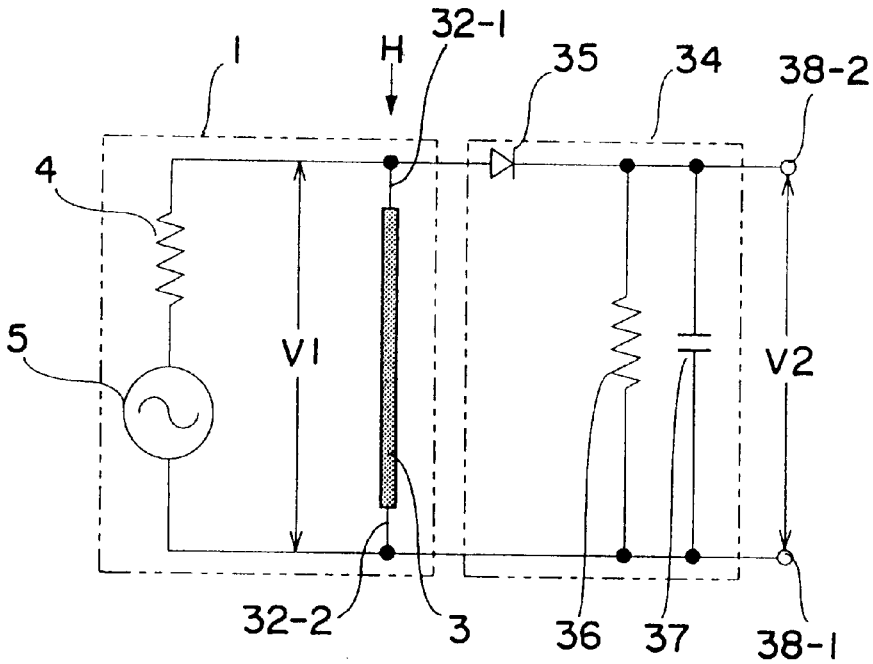
FIG. 4 is a circuit diagram showing operation principle of the magnetic inductance type magnetic sensor.

FIG. 4 shows a circuit for explaining the principle for obtaining amplitude signal from signal that the magnetic sensor 1 outputs. In FIG. 4, the lead lines 32-1 and 32-2 connected to the magnetic line 3 are connected to an oscillating circuit 5 through a current limiting resistor 4 to constitute the magnetic sensor 1.

Figure 5A:
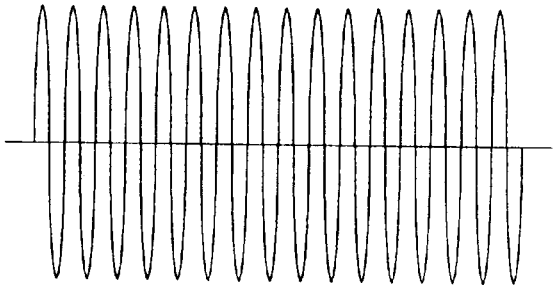
FIG. 5*a* is a waveform diagram of current supplied to the magnetic inductance type magnetic sensor.

FIG. 5*a* shows waveform of high frequency current caused to flow in the magnetic line 3 of the magnetic sensor 1. Frequency of this high frequency current is several MHz to several 10s MHz. However, this invention is not limited to such frequency range. This magnetic line 3 changes inductance or impedance of the magnetic inductance element by external magnetic field by allowing high frequency current varying in point of time to flow therethrough to produce the skin effect. As stated above, the magnetic sensor 1 can obtain output signal proportional to intensity of external magnetic field from that output signal by making use of the fact that inductance changes by external magnetic field.

Moreover, the signal outputted from the magnetic sensor 1 has a signal waveform in which waveform of high frequency current is modulated by waveform changing in correspondence with intensity of external magnetic field. As shown in FIG. 1, there is provided signal extraction means 6 for extracting only signal varying in correspondence with intensity of external magnetic field. As shown in FIG. 4, this signal extraction means 6 is constituted by a detection circuit 34 for obtaining, e.g., amplitude waveform of signal changing in correspondence with intensity of external magnetic field H.

Figure 5B:
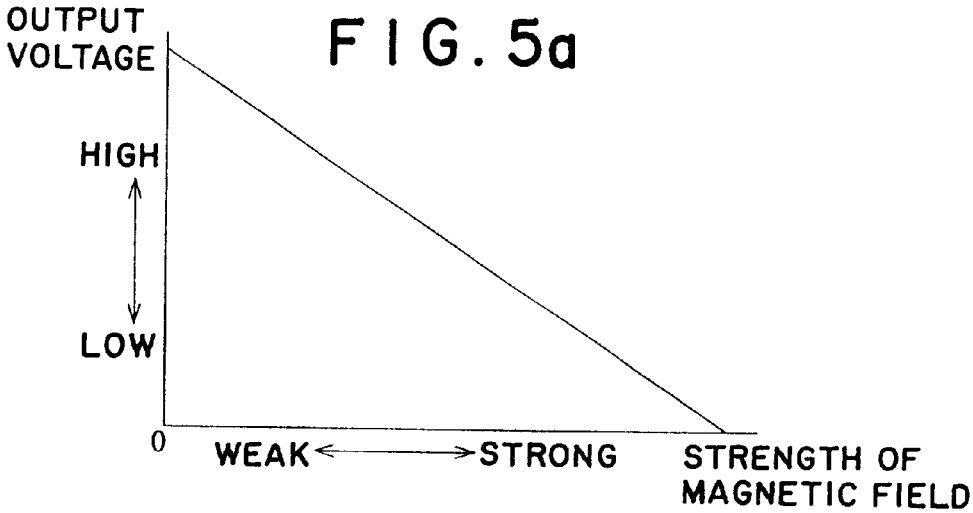
FIG. 5*b* is an output characteristic diagram of the above-mentioned sensor.

This detection circuit 34 is composed of a diode 35 and a smoothing circuit comprising a resistor 36 and a capacitor 37. Across both terminals of output terminals 38-1 and 38-2 of the detection circuit 34 constituted in this way, output having a characteristic proportional to intensity of d.c. component of the external magnetic field H is obtained as shown in FIG. 5*b*. Namely, when the external magnetic field H is weak, voltage across both output terminals 38-1 and 38-2 becomes high. On the other hand, when the external magnetic field H is strong, voltage across both terminals becomes low. Thus, the magnetic sensor 1 can detect voltage of signal proportional to change of the intensity of the external magnetic field H.

Figure 6:
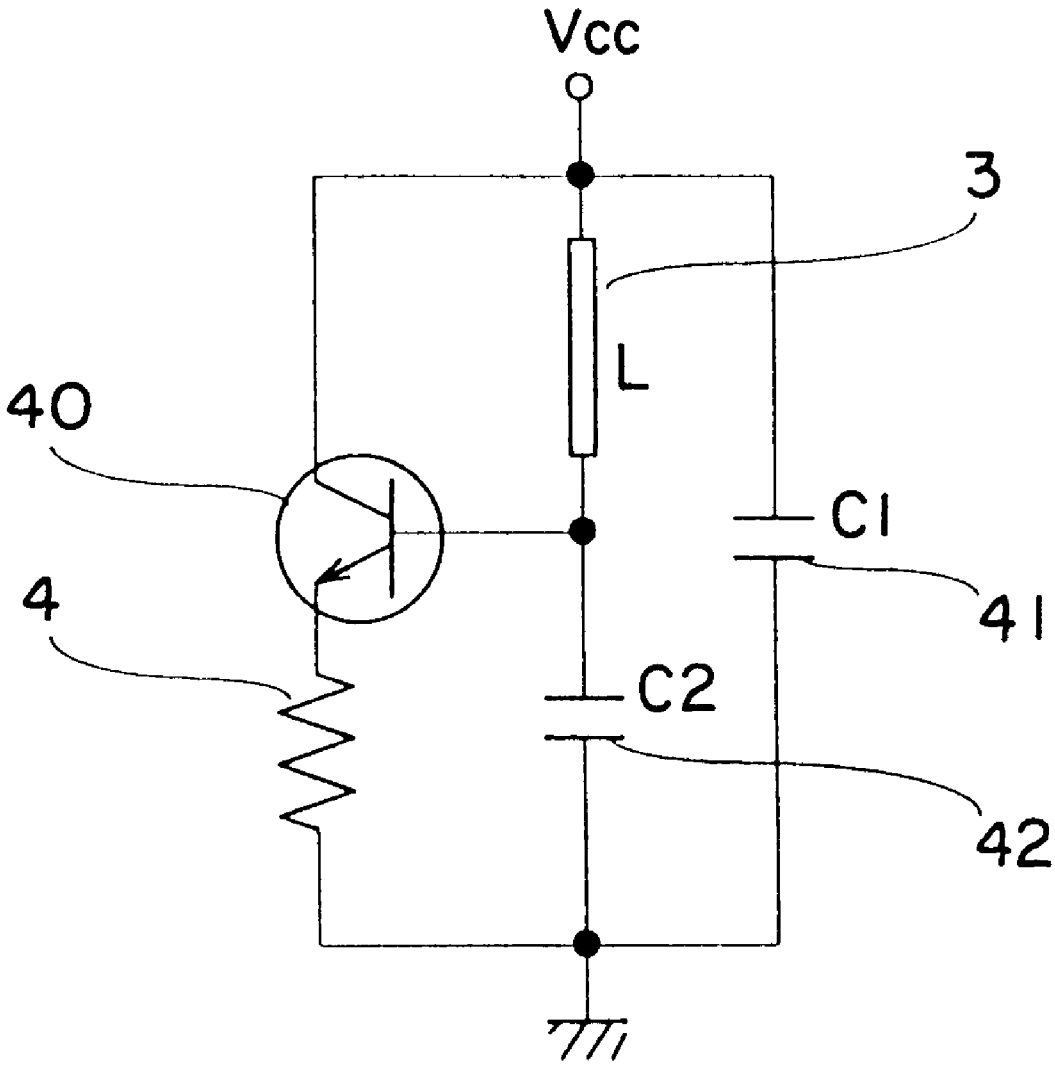
FIG. 6 is a circuit diagram showing an example of circuit configuration of the magnetic inductance type magnetic sensor.

FIG. 6 is a view showing an example of the configuration of a circuit in which magnetic line 3 is used as oscillating element of the self-oscillating type circuit. This circuit is well known Colpitts type LC oscillating circuit. The magnetic line 3 is connected between the collector and the base of a transistor 40, and current limiting resistor 4 is connected between the emitter of the transistor 40 and the ground. In addition, a capacitor 41 (C1) is connected between the collector of the transistor 40 and one end of the current limiting resistor 4, and a capacitor 42 (C2) is connected between base of the transistor 40 and one end of the current limiting resistor 4 thus to constitute a self-oscillating type circuit using the magnetic line 3 as inductance of the oscillating element.

Oscillating frequency of the self-oscillating type circuit constituted as shown in FIG. 6 is determined by inductance of the magnetic line 3 and values of the capacitor 41 (C1) and the capacitor 42 (C2), and can be determined by the following formula. In actual circuit, these circuit constants are values including inductance and stray capacitance, etc. of lead lines 32-1 and 32-2 to be connected.

$$f=\tfrac{1}{2}\pi\{L(C1+C2)/C1/C2\}^{1/2}$$

Moreover, from FIG. 6, similarly to the fact described in the principle circuit of FIG. 4, it is possible to detect, through the magnetic line 3, signal proportional to intensity of externally applied magnetic field by making use of the fact that impedance changes by externally applied magnetic field.

In this example, in, e.g., one dollar bill of U.S.A., etc. printed by magnetic ink, strength of residual magnetism in space spaced by about 1 mm from the surface thereof is about $10^{-4}$ Oe (Oersted) to $10^{-3}$ Oe (Oersted). The magnetic sensor 1 is disposed so as to take right angle in a manner opposite to the surface of bill 20 to be tested as shown in FIG. 3 with respect to the bill 20 to be tested having such residual magnetism, and the magnetic sensor 1 is disposed in a manner spaced by a predetermined distance from the surface of the bill 20 to be tested.

Figure 8:
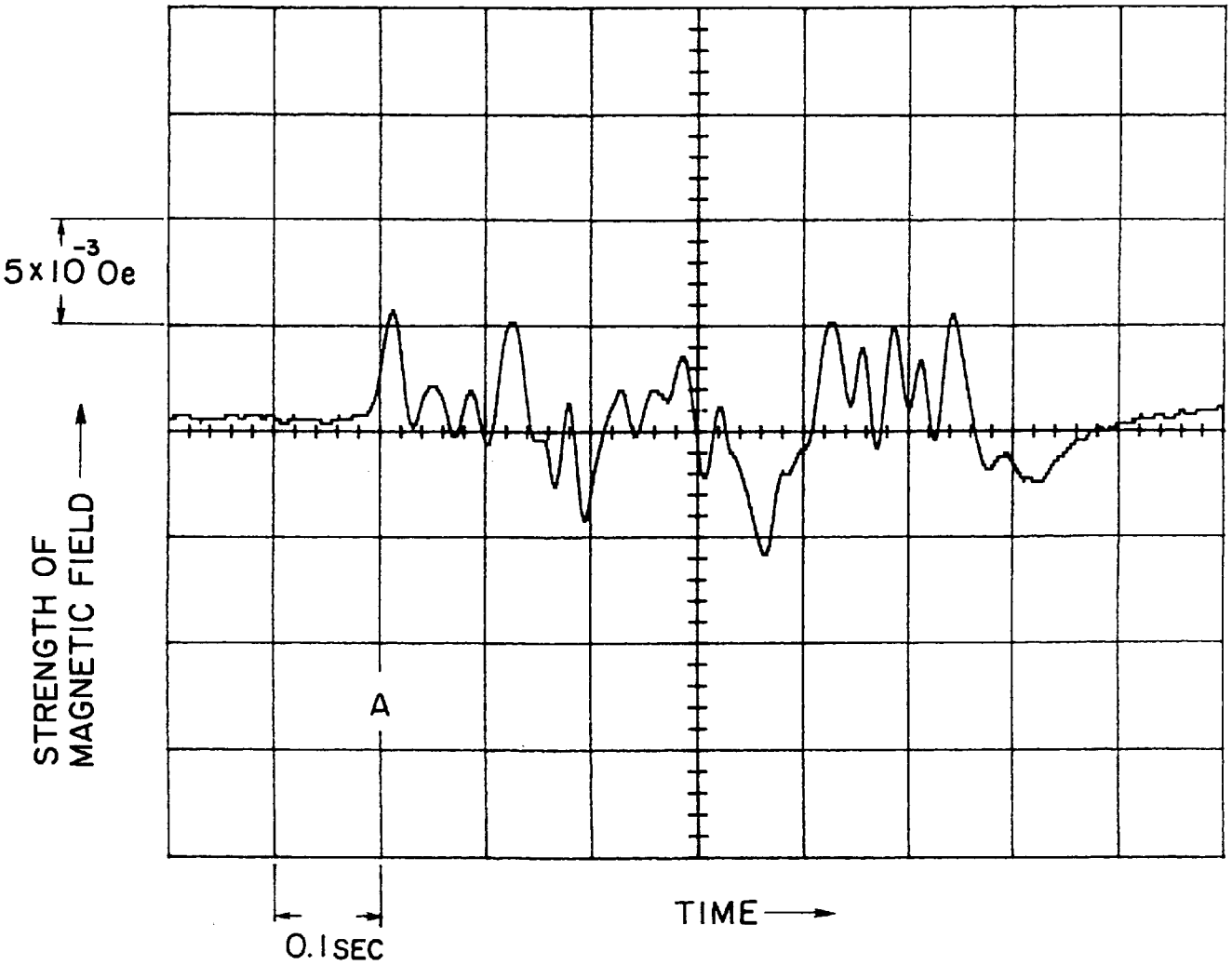
FIG. 8 is a waveform diagram showing output example of the magnetic inductance type magnetic sensor.

The magnetic sensor 1 disposed in this way scans the magnetic printing portion 22 of the bill 20 to be tested in a manner opposite thereto to deliver output signal obtained from the magnetic sensor 1 at that time to signal extraction means 6 (FIG. 1). The signal extraction means 6 serves to extract signal varying in response to the magnetic printing portion 22 of the bill 20 to be tested from the magnetic sensor 1, and signal waveform as shown in FIG. 8 is obtained from the signal extraction means 6. Output of the signal extraction means 6 is inputted to the comparative judgment means 7 as shown in FIG. 1. Moreover, the comparative judgment means 7 is connected to reference value signal generating means 8, and reference values (upper limit value, lower limit value) in suitable bill, i.e., circulating bill which can be received of a given money kind determined in advance are set at this reference value signal generating means 8. Reference values set at the reference value signal generating means 8 are function value determined from statistical data obtained by measuring such circulating bill in advance by using the magnetic sensor 1.

The comparative judgment means 7 compares a signal inputted from the signal extraction means 6 and a signal inputted from the reference value signal generating means 8 to judge whether or not the signal inputted from the signal extraction means 6 is within reference value, whereby when the signal is within the reference value, it outputs, to external unit (not shown), a signal indicating that the bill 20 to be tested is true. However, when signal is not within the reference value, it outputs, to external unit (not shown), a signal indicating that the bill 20 to be tested is false. In this way, it is possible to test true/false property of the bill to be tested.

Figure 7:
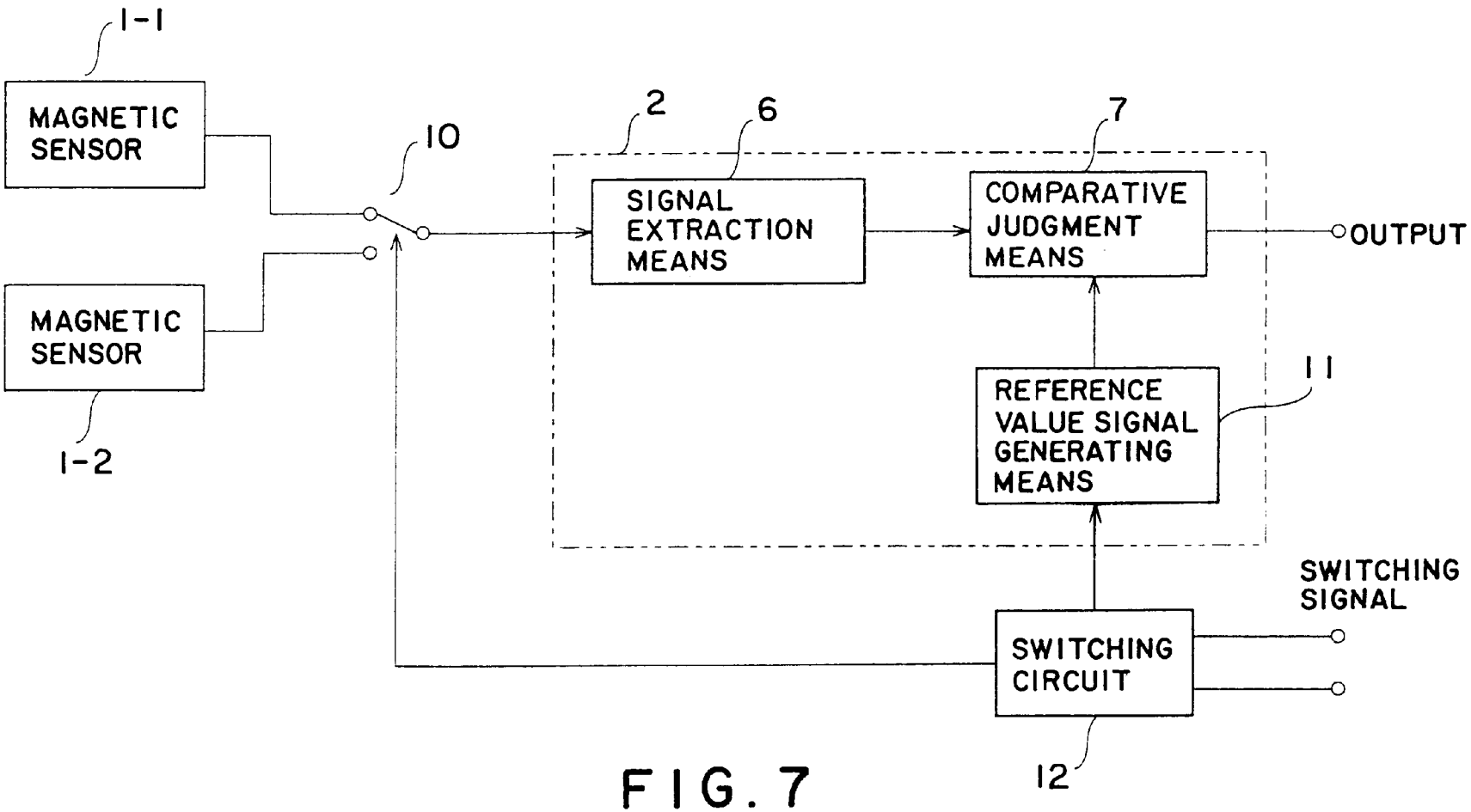
FIG. 7 is a block diagram showing another embodiment of true/false property testing circuit for bill to be tested according to this invention.

FIG. 7 shows, by the block diagram, another embodiment of this invention adapted for carrying out switching between the magnetic printing portion 22 and the non-magnetic printing portion 21 in given circulating bills which can be received in money kind determined in advance from detection output of the magnetic sensor 1 to discriminate therebetween.

In this FIG. 7, the magnetic sensor 1 is the magnetic inductance type magnetic sensor, and means for testing bill 20 to be tested by using signal obtained from the magnetic sensor 1 is similar to the circuit shown in FIG. 1. In this example, in FIG. 7, the same reference numerals as the reference numerals used in FIG. 1 are respectively attached to the portions which perform functions similar to the embodiment shown in FIG. 1 so that they correspond to each other, and the detailed explanation is omitted.

In FIG. 7, the magnetic sensor 1-1 serves to test magnetic printing portion 22 of bill 20 to be tested shown in FIG. 2, and the magnetic sensor 1-2 serves to test non-magnetic printing portion of the bill 20 to be tested.

Moreover, a selector (changeover) switch 10 is a switch operative on the basis of an output signal from a switching circuit 12, and the selector switch 10 is switched in order to input any one of outputs of the magnetic sensors 1-1, 1-2 to signal extraction means 6. This selector switch 10 is switched by an output signal from the switching circuit 12 operative by a switching signal from external unit (not shown).

Further, any one of output signals of the magnetic sensors 1-1, 1-2 selected at the selector switch 10 is tested at testing means 2. The signal extraction means 6 of the testing means 2 extracts at least one of a signal changing in response to the magnetic printing portion 22 of the bill 20 to be tested and signal responsive to the non-magnetic printing portion corresponding to any one of output signals of the magnetic sensors 1-1, 1-2. The signal extracted at the signal extraction means 6 is compared with reference value generated at the reference value signal generating means 11 at the comparative judgment means 7.

The comparative judgment means 7 is operative so that if signal is within the reference value, it judges that bill 20 to be tested is in correspondence with circulating bill of a given money kind determined in advance to output, to external unit (not shown), a signal indicating that the bill 20 to be tested is true. However, when signal is not within the reference value, the comparative judgment means 7 outputs, to external unit (not shown), a signal indicating that the bill 20 to be tested is false. In this way, by testing the portion that the bill 20 to be tested includes the magnetic printing portion 22 and the portion that it does not include that portion, it is possible to test, with high accuracy, irregular bill to be tested, e.g., resulting from the fact that there is no magnetic reaction (response) at a predetermined portion of bill to be tested, or there is magnetic reaction (response) at the portion where magnetic reaction (response) should not take place.

In this example, the reference value signal generating means 11 changes its reference value generated with respect to the operation of the selector switch 10 corresponding to output signal of the switching circuit 12. This is because reference values for judging signal obtained by detecting the magnetic printing portion 22 detected by the magnetic sensor 1-1 and signal that the magnetic sensor 1-2 detects the non-magnetic printing portion are different from each other.

Further, the magnetic inductance type magnetic sensor 1 surrounds, by a magnetic shield 33, the surface except for the surface opposite to the bill 20 to be tested as shown in FIG. 3 thus to improve detection accuracy. This magnetic shield 33 can interrupt leakage magnetic flux produced from power supply of bill discrimination unit (not shown) or a carrying motor 53 for carrying bill 20 to be tested. As a result, S/N ratio of signal detected from the magnetic sensor 1 is improved. Thus, detection accuracy is improved.

FIG. 8 shows an example of output waveform in the case where the magnetic printing portion 22 of the bill to be tested is detected by magnetic inductance type magnetic sensor 1. The bill 20 to be tested is carried, whereby detection output of the magnetic inductance type magnetic sensor 1 starts vibration at position opposite to the magnetic printing portion 22 (position of A in the figure). In this case, the reason why magnitudes of waveforms of detection outputs are different from each other is based on difference between detected intensities of residual magnetic fields of the magnetic printing portion 22. From magnitude of output waveform of this detection output, intensity of detected magnetic field can be recognized.

Figure 9:
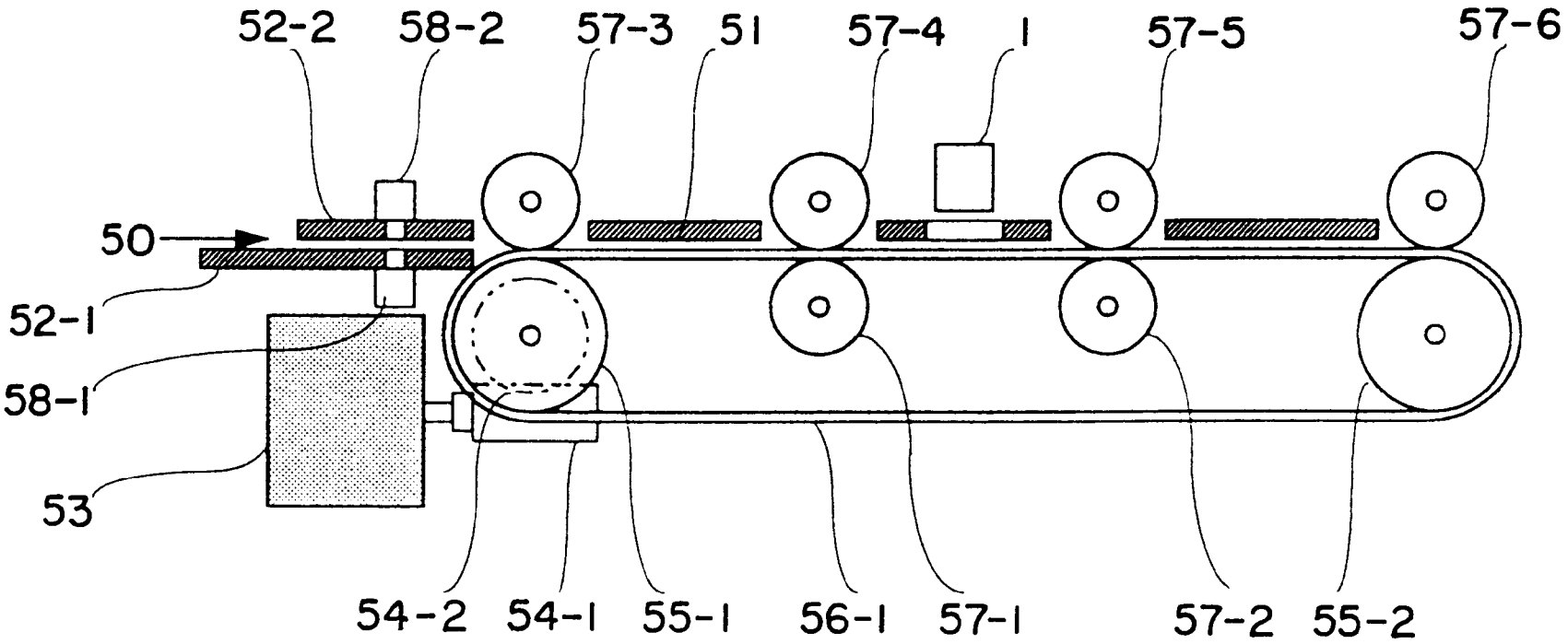
FIG. 9 is a side view showing outline of the mechanism of an embodiment of a bill discriminating apparatus of this invention.
Figure 10:
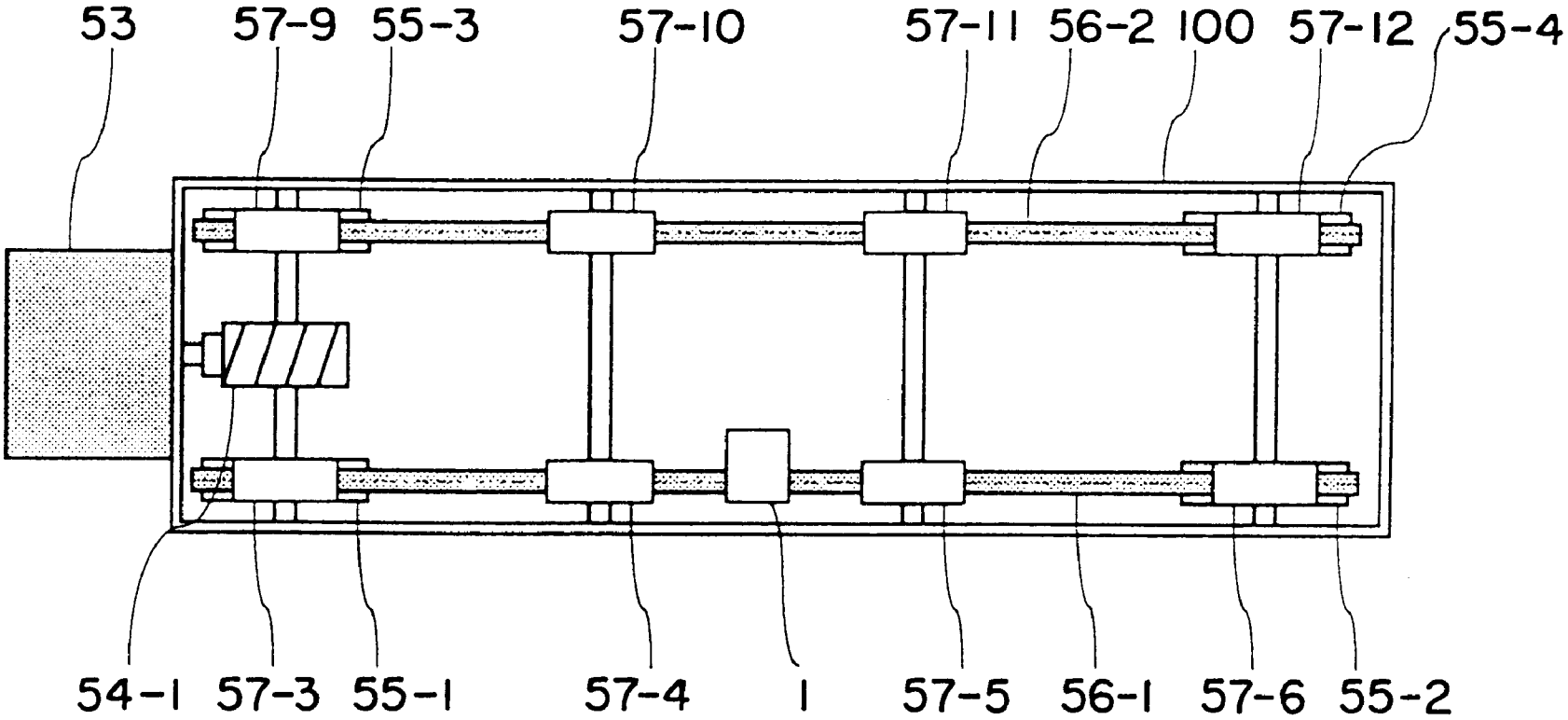
FIG. 10 is a plan view corresponding to FIG. 9 showing outline of the mechanism of the embodiment of this invention.

FIG. 9 is a side view showing the outline of the configuration of an embodiment of the bill discrimination unit employing the method and the apparatus for testing true/false property of bill to be tested according to this invention, and FIG. 10 is a plan view thereof.

As shown in FIGS. 9 and 10, this bill discrimination unit is of a structure comprising a carrying passage 51 for guiding bill to be tested in the direction indicated by arrow from an insertion hole 50, entrance sensors 58-1, is 58-2 for detecting bill to be tested which has been inserted in the direction indicated by arrow from the insertion hole 50, magnetic sensor 1 for detecting magnetic printing portion 22 shown in FIG. 2 formed at the bill 20 to be tested, which is carried by carrying belts 56-1, 56-2 for carrying bill to be tested inserted from the insertion hole 50 along the carrying passage 51 and rollers 57-1, 57-2, 57-3, 57-4, 57-5, 57-6, 57-7, 57-8, 57-9, 57-10, 57-11, 57-12, and a motor 53 for driving worm gears 54-1, 54-2, worm gears 54-1, 54-2 for transmitting power to the carrying belts 56-1, 56-2.

The operation of this bill discriminating unit 100 will now be described.

The bill 20 to be tested inserted from the insertion hole 50 is moved in the direction indicated by arrow and is detected by the entrance sensors 58-1, 58-2 of the optical sensor to start the motor 53 by control means (not shown) on the basis of a signal that this entrance sensor 58 outputs. The output shaft of the motor 53 is connected to the worm gears 54-1, 54-2 to transmit, to pulley 55-1, 55-3, power of the motor 53 to rotate the pulley 55-1, 55-3 in a predetermined direction. In addition, across the pulley 55-1 rotated by power of the motor 53 and a pulley 55-2 disposed in a manner spaced by a predetermined distance, and across the pulley 55-3 and a pulley 55-4 disposed in a manner spaced by a predetermined distance, carrying belts 56-1 and 56-2 are respectively laid to drive carrying belts 56-1, 56-2.

Moreover, at the carrying belts 56-1, 56-2, there are provided rollers 57-1, 57-2, 57-3, 57-4, 57-5, 57-6, 57-7, 57-8, 57-9, 57-10, 57-11, 57-12 disposed at predetermined intervals. The rollers 57 push bill 20 to be tested in a manner such that the bill 20 to be tested is put therebetween to carry the bill 20 to be tested. The bill 20 to be tested inserted from the insertion hole 50 is moved in the direction indicated by arrow to shortly come to the detection area of the magnetic sensor 1 to further move. The magnetic sensor 1 detects, in non-contact manner, the magnetic printing portion 22 shown in FIG. 2 formed at the moving bill 20 to be tested to output a signal responsive thereto.

(Other embodiments)

While oscillating circuit of the Colpitts type is shown as an example of the oscillating circuit, it may be replaced by Hartley type oscillating circuit, clamping type oscillating circuit, or Lampkin type oscillating circuit.

(Advantages with the invention)

As explained above, in accordance with this invention, since there is employed such a configuration that non-contact type magnetic sensor is disposed at the bill carrying path of the bill discriminating unit to detect, in non-contact manner, on the basis of detection output of this magnetic sensor, whether or not a predetermined magnetic printing portion is formed at the inserted bill to be tested, or whether or not there is magnetic reaction (response) from the non-magnetic printing portion, locus of detection position is not left at the surface of bill to be tested so that improvement in the security can be made, and there is no mechanical friction because of non-contact system so that life time of the unit is elongated. In addition, degradation by breakage, etc. of the bill itself can be prevented by the non-contact system. Thus, reasonable processing of bill can be carried out.

Figure 11:
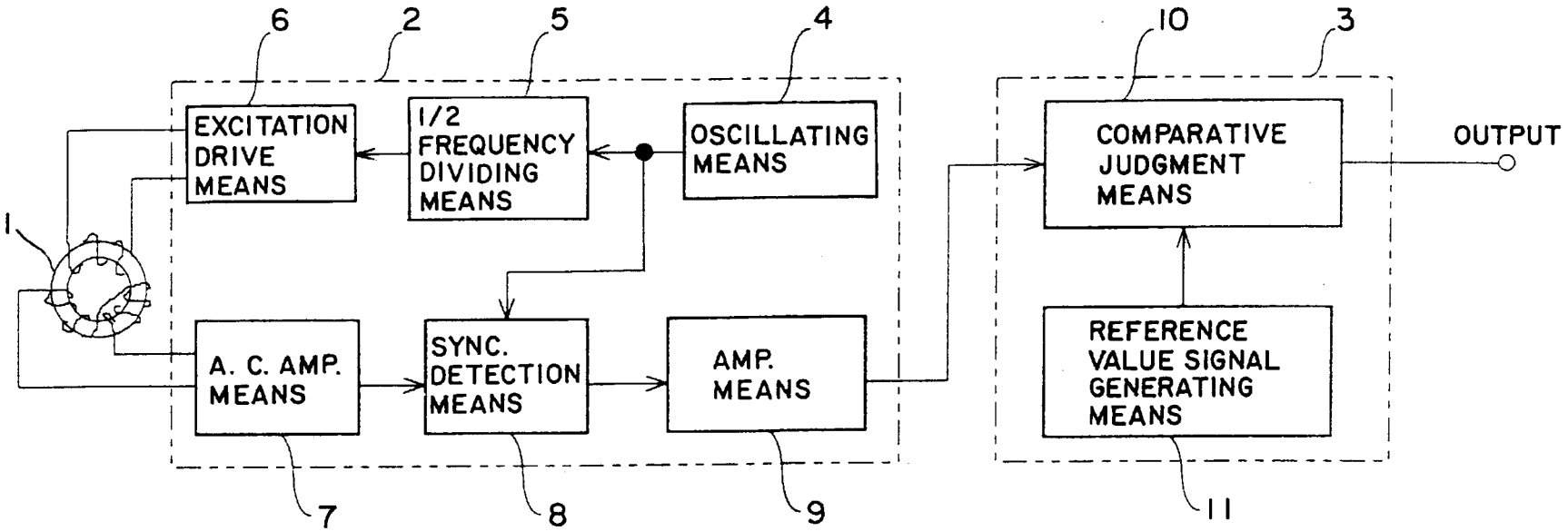
FIG. 11 is a block diagram showing an embodiment of a true/false property testing circuit for bill to be tested according to this invention.

FIG. 11 is a block diagram showing an embodiment of a true/false property testing circuit of bill to be tested according to this invention. This true/false property testing circuit for bill is caused to be of structure by using computer in practice.

In FIG. 11, the magnetic sensor 1 is constituted by thin film flux gate type magnetic sensor which is one kind of the non-contact system magnetic sensor. This thin film flux gate type magnetic sensor 1 serves to detect the influence by action of external magnetic field with respect to the magnetic sensor 1 in cooperation with magnetic sensor control means 2 to deliver a detection signal to judging means 3.

Further, the thin film flux gate type magnetic sensor has a configuration in which excitation coil and detection coil are wound at the closed magnetic path core. In accordance with the operation principle, high frequency excitation magnetic field is applied to the closed magnetic path core by excitation coil wound on the closed magnetic path core to detect induction current by excitation magnetic field by detection coil wound on the closed magnetic path core. Namely, change of electromagnetic action within the closed magnetic path core by external magnetic field, i.e., change of excitation state is detected by the detection coil.

Further, a detection signal of the magnetic sensor 1 is delivered to the judging means 3 through the magnetic sensor control means 2. The judging means 3 includes comparative judgment means 10 and reference value signal generating means 11, and serves to form an output signal corresponding to detection signal of the magnetic sensor 1.

In addition, the thin film flux gate type magnetic sensor 1 can utilize impedance change with respect to external magnetic field, i.e., externally applied magnetic field. With respect to the thin film flux gate type magnetic sensor having such features, utilization of very weak magnetic field measurement, etc. is proposed as high sensitivity magnetic sensor operative at room temperature.

Figure 12:
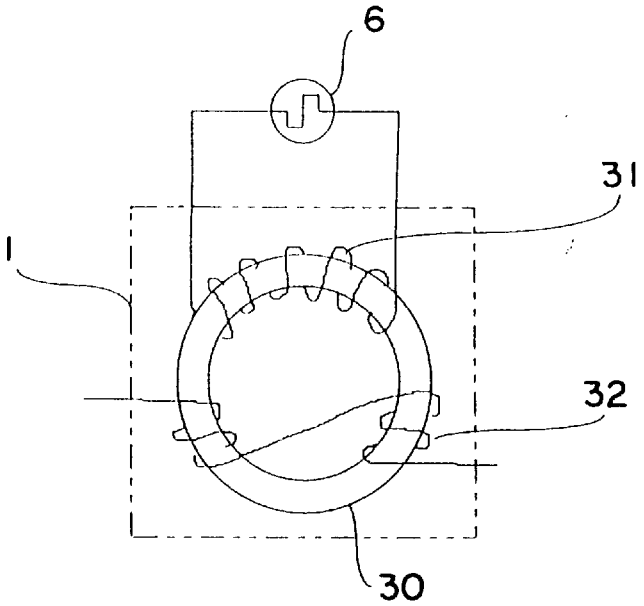
FIG. 12 is a view showing an example of the configuration of thin film flux gate type magnetic sensor used in the embodiment of FIG. 1.

FIG. 12 shows an example of the configuration of the thin film flux gate type magnetic sensor. As shown in FIG. 12. the magnetic sensor 1 is formed so as to take chip shape having size (dimensions) in which each side is about several mm, and is adapted so that wiring pattern such as coil, etc. is formed on substrate by the photolithographic technology and the etching technology, and an insulating layer and a magnetic core layer are formed by the high frequency sputtering process. In addition, the magnetic core layer is formed so as take ring shape, and coil and its drawing line are formed in such a manner that insulating layer is interposed with respect to this magnetic core layer.

At the magnetic core layer formed so as to take ring-shape, i.e., ring core 30, there are wound an excitation coil 31 connected to an excitation source 6, and a detection coil 32 invert-connected and differentially connected at the middle portion. The excitation source 6 serves to deliver, e.g., high frequency current having frequency 500 kHz to the excitation coil 31. Thus, the ring core 30 is excited at high frequency. Further, excitation state of the ring core 30 is detected by the detection coil 32. The ring core 30 is placed so that the ring surface is in parallel to the surface of bill to be tested. As a result, the ring core 30 excited by the excitation coil 31 undergoes magnetic action in correspondence with magnetization state of bill to be tested. Thus, magnetization state of bill to be tested is detected by the detection coil 32.

Figure 13:
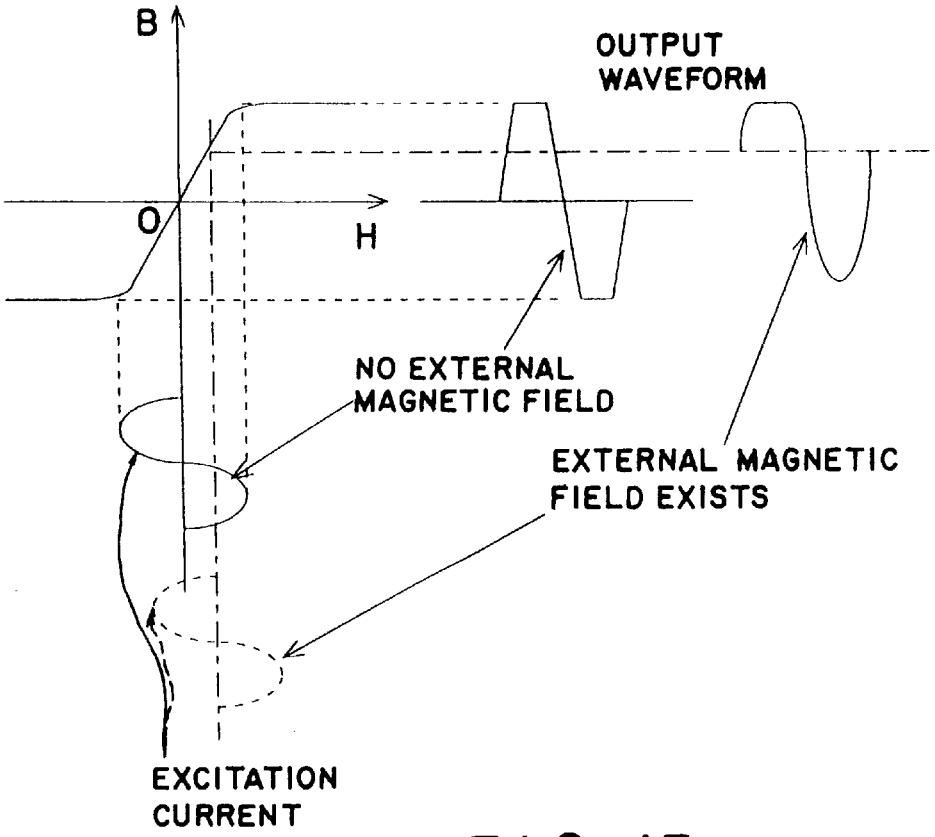
FIG. 13 is a characteristic diagram showing the operation principle of the thin film flux gate type magnetic sensor.

FIG. 13 is a B-H characteristic view for explaining the operation principle of the magnetic sensor 1 as input/output. As shown in FIG. 13, if there is no external magnetic field around the magnetic sensor 1, high frequency excitation current swings with the 0 (zero) point which is the operating point being as center, and output signal also takes +, − symmetrical waveform with the 0 point being as center. On the contrary, if there is external magnetic field, bias is applied by such an external magnetic field. As a result, the operating point moves toward the + side in this case as indicated by broken lines, and + side waveform is contracted. Thus, there results a signal in which one side waveform has large amplitude so as to take sine waveform shape.

If no external magnetic field exists, magnetic flux within the ring core 30 changes so as to take rectangular shape. Accordingly, the odd order harmonics are included in signal induced at the receiving coil and outputted from the output terminal. In addition, if external magnetic field exists, the magnetic field is strengthened in any either one direction. As a result, as shown in FIG. 13, change of magnetic flux within the ring core 30 by excitation current is such that the magnetic flux in any one direction (in negative direction in FIG. 13) is not saturated.

Thus, even order harmonics are included in addition to odd order harmonics in signal induced at the receiving coil and outputted from the output terminal. The magnitude of the even order harmonics is proportional to magnitude of d.c. component of external magnetic field. Accordingly, the magnetic sensor scans the portion printed by magnetic ink in bill to be tested. When magnetic field corresponding to external magnetic field is applied, the magnetic sensor forms an output signal corresponding thereto.

Figure 14:
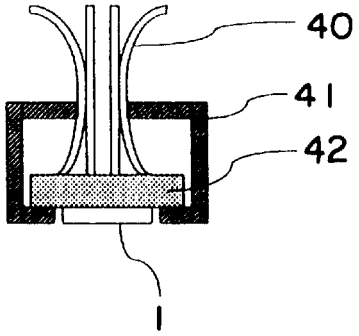
FIG. 14 is a view showing the structure of the thin film flux gate type magnetic sensor.

FIG. 14 shows external shape of the magnetic sensor 1, wherein there is provided a sensor of a structure as shown in FIG. 12 on a substrate 42 accommodated within a magnetic shield 41, and is connected to lead lines 40. The magnetic shield 41 is of a structure in which only the detection surface, i.e., the surface (lower surface in FIG. 14) opposite to bill is opened and the other surface is closed to prevent influence of magnetic disturbance as far as possible.

In this case, e.g., one dollar bill of U.S.A. printed by magnetic ink, etc. is such that intensity of residual magnetism in space spaced by about 1 mm from the surface thereof is about 10–40 e (Oersted) to 10–30 e (Oersted). With respect to the bill 20 to be tested having such residual magnetism, the magnetic sensor 1 is disposed in such a manner that the detection surface is opposite to the bill 20 to be tested. In addition, the magnetic sensor 1 is disposed in a manner spaced by a predetermined distance from the surface of bill 20 to be tested.

Figure 16:
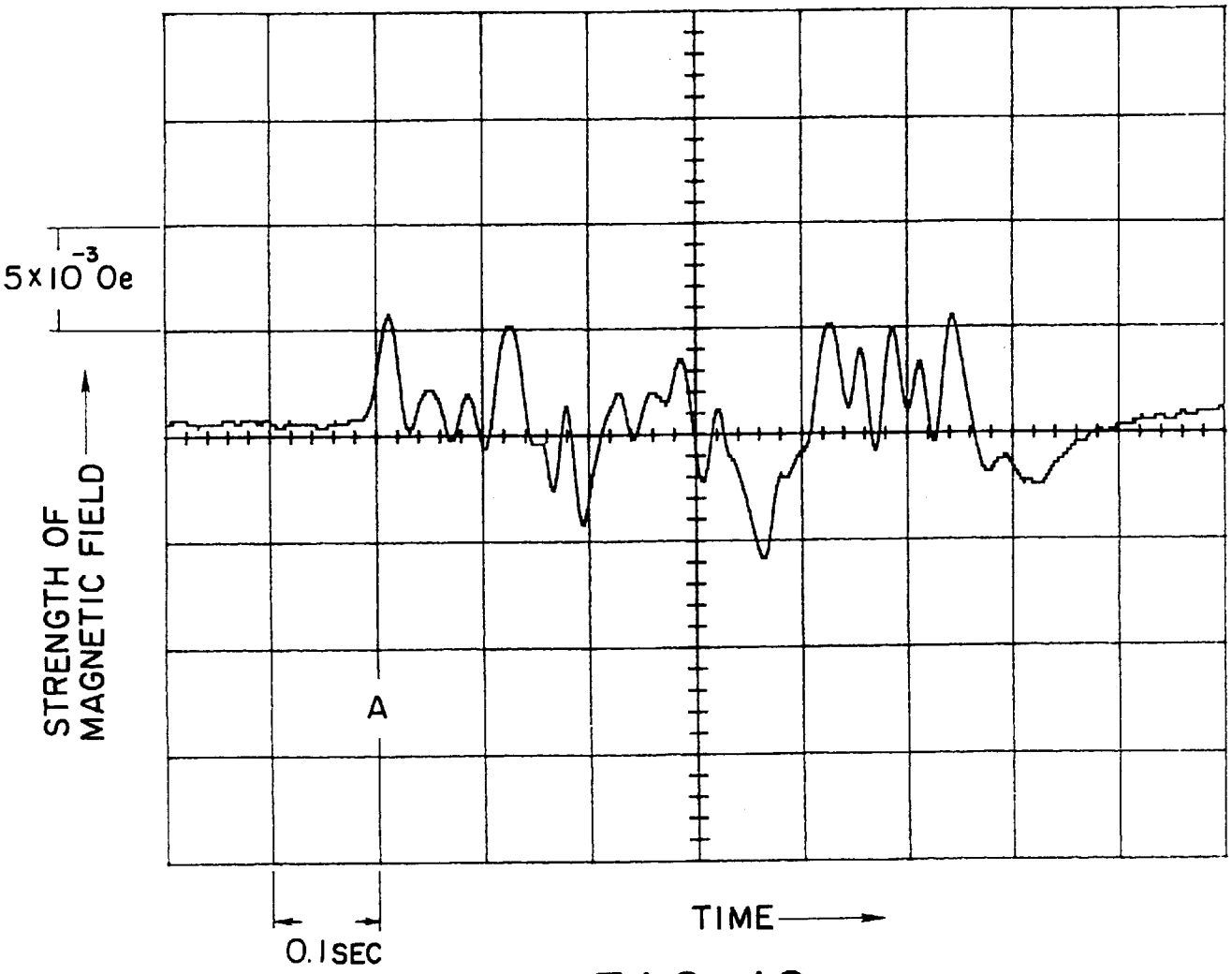
FIG. 16 is a view showing output waveform obtained by scanning bill to be tested by the thin film flux gate type magnetic sensor.

The magnetic sensor 1 disposed in this way scans magnetic printing portion 22 of bill 20 to be tested in a manner opposite thereto to deliver an output signal obtained from the magnetic sensor 1 at that time to magnetic sensor control means 2 (FIG. 11). The magnetic sensor control means 2 serves to extract a signal varying in response to the magnetic printing portion 22 of bill 20 to be tested. Thus, a signal waveform as shown in FIG. 16 is obtained from the magnetic sensor control means 2. As shown in FIG. 11, output of the magnetic sensor control means 2 is inputted to the comparative judgment means 10. Moreover, the comparative judgment means 10 is connected to reference value signal generating means 11, and reference values (upper limit value, lower limit value) in suitable bill, i.e., circulating bill of a given money kind which can be received predetermined in advance are set at this reference value signal generating means 11. The reference value set at the reference value signal generating means 11 is based on statistical data, and this statistical data is function value obtained by measuring, in advance, circulating bill by using the magnetic sensor 1.

The comparative judgment means 10 compares signal inputted from the magnetic sensor control means 2 and signal inputted from the reference value signal generating means 11 to judge whether or not signal inputted from the magnetic sensor control means 2 is within the reference value, whereby if signal is within the reference value, it outputs, to external unit (not shown), a signal indicating that the bill 20 to be tested is true. However, when signal is not within the reference value, it outputs, to external unit (not shown), a signal indicating that the bill 20 to be tested is false. In this way, true/false property of the bill to be tested can be tested.

Figure 15:
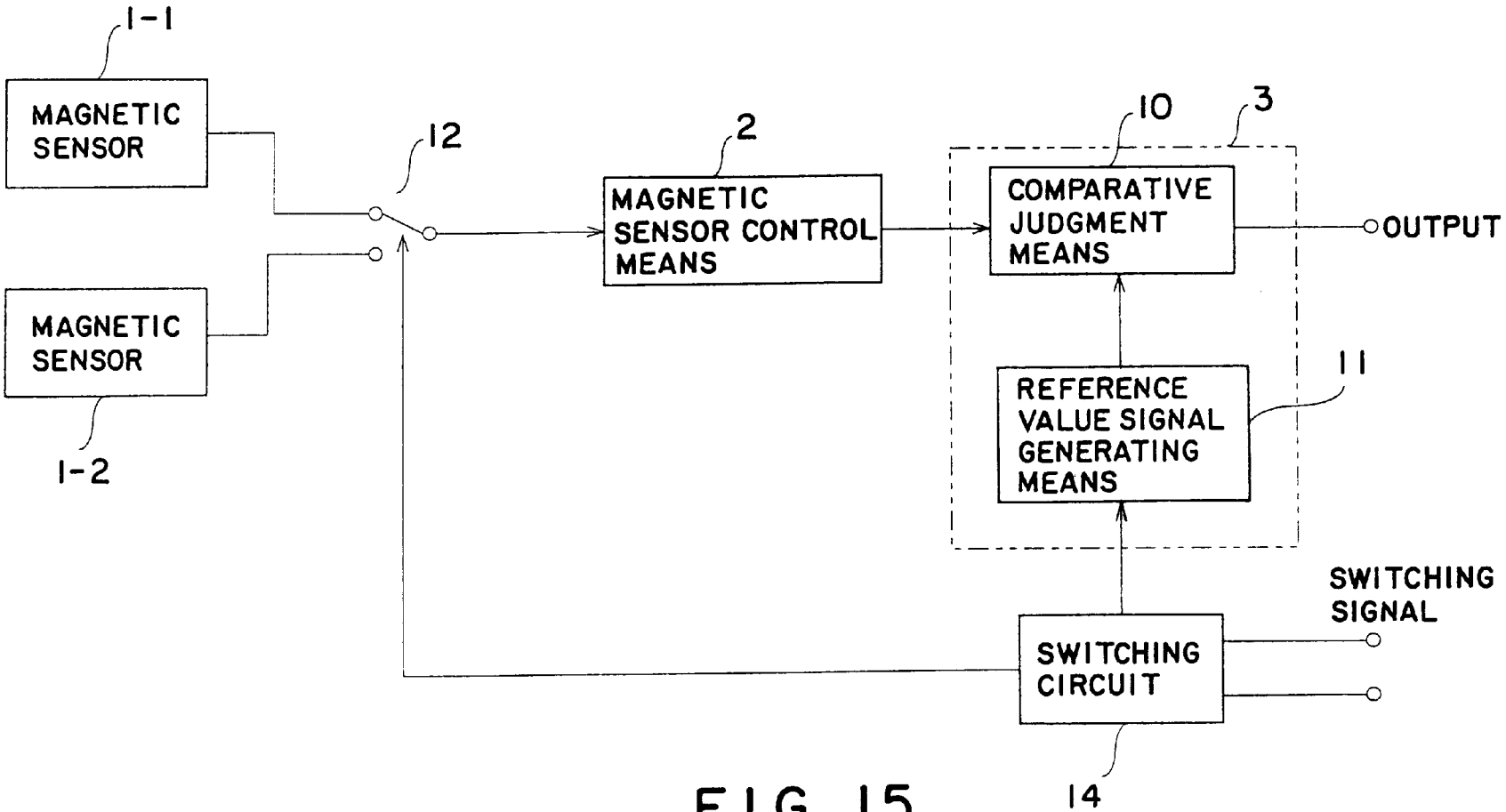
FIG. 15 is a block diagram showing a further embodiment of true/false property testing circuit for bill to be tested according to this invention.

FIG. 15 is a block diagram showing another embodiment of this invention, wherein the true/false property testing circuit of this embodiment is adapted to carry out switching between the magnetic printing portion 22 and the non-magnetic printing portion 21 in given circulating bill which can be received in a kind of money predetermined in advance from detection output of the magnetic sensor 1 to discriminate therebetween.

In FIG. 15, the magnetic sensor 1 is thin film flux gate type magnetic sensor, and means for testing bill 20 to be tested by using signal obtained from the magnetic sensor 1 is similar to that in the circuit shown in FIG. 1. It is to be noted that, in FIG. 15, the same reference numerals as reference numerals used in FIG. 1 are respectively attached to portions which perform functions similar to those of the embodiment shown in FIG. 1 so that they are caused to correspond to each other, and its detailed explanation is omitted.

Further, in FIG. 15, the magnetic sensor 1-1 serves to test the magnetic printing portion 22 of the bill 20 to be tested shown in FIG. 2, and the magnetic sensor 1-2 serves to test the non-magnetic printing portion of the bill 20 to be tested.

Further, the selector switch 12 is a switch operative on the basis of output signal from the switching circuit 14, and the selector switch 12 is switched in order to input either one of outputs of the magnetic sensors 1-1, 1-2 to the magnetic sensor control means 2. This selector switch 12 is switched in accordance with output signal from the switching circuit 14 operative by switching signal from external unit (not shown).

In addition, output signal of any one of the magnetic sensors 1-1, 1-2 selected by the selector switch 12 is delivered to judgment means 3 via magnetic sensor control means 2. The signal delivered to the judgment means 3 via the magnetic sensor control means 2 is compared with reference value generated at the reference value signal generating means 11 in this comparative judgment means 10.

The comparative judgment means 10 is operative so that if signal is within the reference value, it considers the bill 20 to be tested to be in correspondence with circulating bill of a given money kind determined in advance to output, to external unit (not shown), a signal indicating that the bill 20 to be tested is true. However, when signal is not within the reference value, the comparative judgment means 10 outputs, to external unit (not shown), a signal indicating that the bill 20 to be tested is false. In this way, by testing the portion in which the bill 20 to be tested has magnetic printing portion 22 and the portion in which the bill 20 to be tested has not magnetic printing portion 22, it is possible to test, with high accuracy, irregal bill to be tested, e.g., resulting from the fact that there is no magnetic reaction (response) at a predetermined portion of bill to be tested and there is magnetic reaction (response) at the portion where the magnetic reaction (response) should not take place, or the like.

In this case, the reference value signal generating means 11 changes its reference value generated with respect to the operation of the selector switch 12 corresponding to output signal of the switching circuit 14. This is because reference values for judging signal obtained when the magnetic sensor 1-1 has detected magnetic printing portion 22 and signal obtained when the magnetic sensor 1-2 has detected the non-magnetic printing portion are different from each other.

Moreover, as shown in FIG. 14, the thin film flux gate type magnetic sensor 1 surrounds the surface except for the surface opposite to the bill 20 to be tested by the magnetic shield 41 to make improvement in the detection accuracy. This magnetic shield 41 can interrupt leakage magnetic flux produced from power supply of bill discriminating unit (not shown) or carrying motor 53 which carries the bill 20 to be tested, or the like. As a result, S/N ratio of signal detected from the magnetic sensor 1 is improved. Thus, detection accuracy is improved.

FIG. 16 shows an example of detection output waveform of thin film flux gate type magnetic sensor 1 obtained by scanning the magnetic printing portion 22 of the bill 20 to be tested. The bill 20 to be tested is carried and detection output of the thin film flux gate type magnetic sensor 1 starts vibration at position opposite to the magnetic printing portion 22 (portion of A in the figure). In this case, the reason why magnitudes of waveforms of detection outputs are different from each other is based on difference between detected intensities of residual magnetic fields of the magnetic printing portion 22. From magnetitude of output waveform of this detection output, intensity of detected magnetic field can be recognized.

Figure 17:
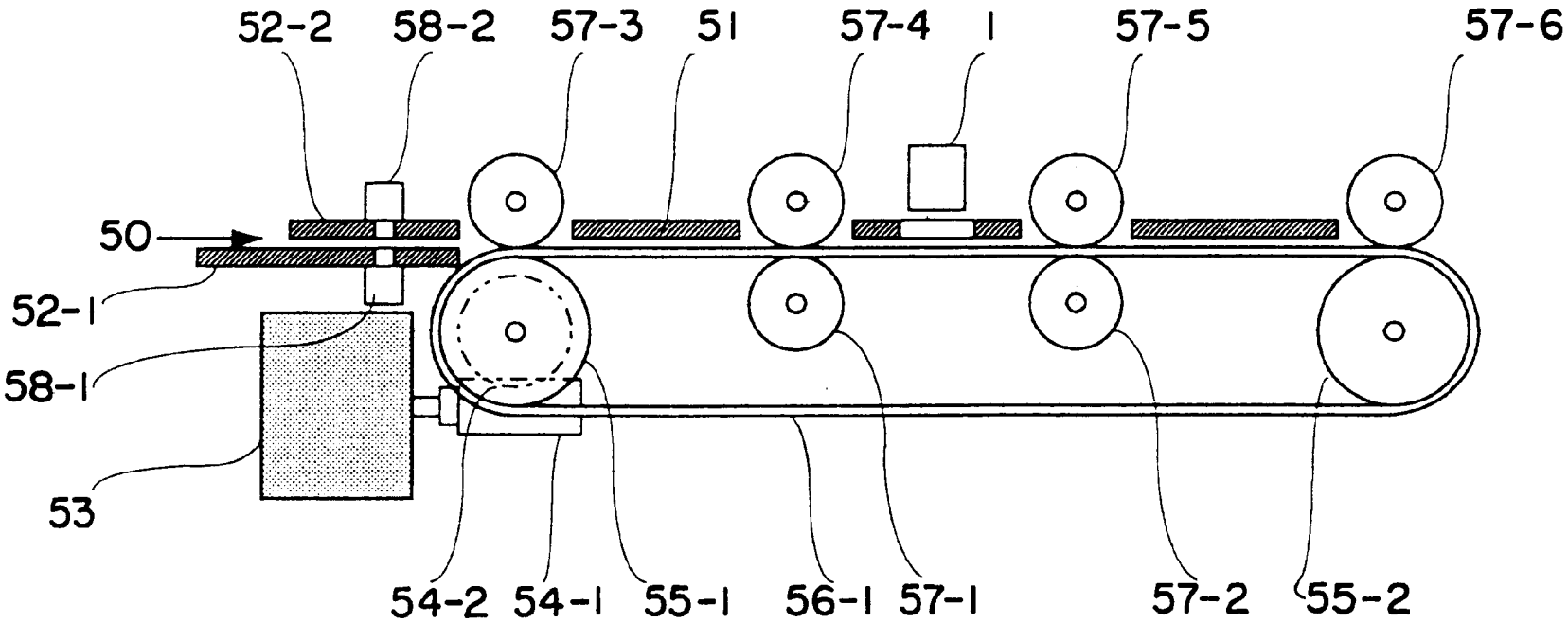
FIG. 17 is a side view showing outline of the mechanism of the embodiment of a bill discriminating unit of this invention
Figure 18:
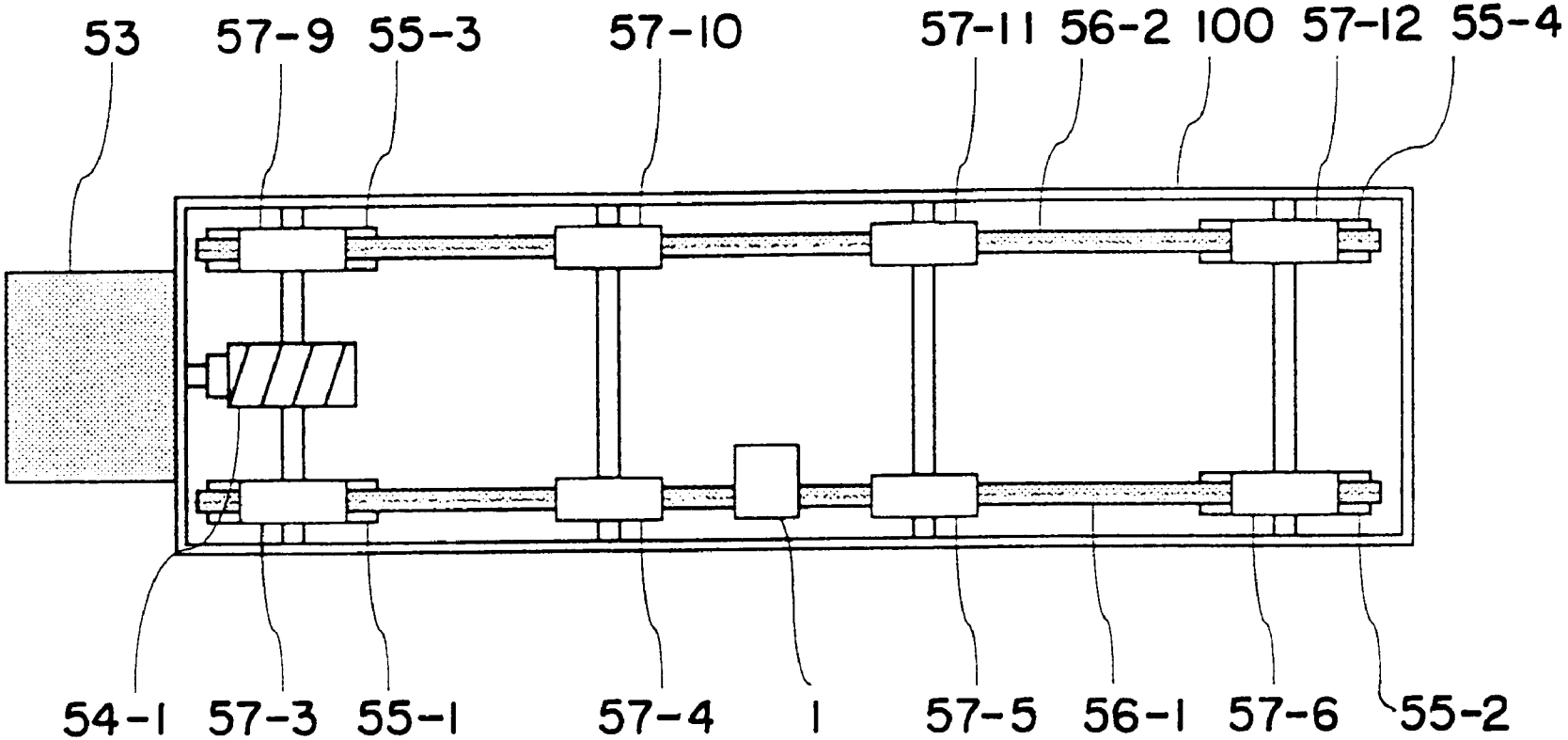
FIG. 18 is a plan view corresponding to FIG. 17 showing outline of the mechanism of the embodiment of this invention.

FIG. 17 is a side view showing outline of the configuration of an embodiment of the bill discriminating unit employing a method and an apparatus for testing true/false property of bill to be tested according to this invention, and FIG. 18 is a plan view thereof.

As shown in FIGS. 17 and 18, this bill discriminating unit comprises, as main components, a carrying passage 51 for guiding bill to be tested in the direction indicated by arrow from the insertion hole 50, entrance sensors 58-1, 58-2 for detecting the bill to be tested inserted in the direction indicated by arrow from the insertion hole 50, carrying belts 56-1, 56-2 and rollers 57-1, 57-2, 57-3, 57-4, 57-5, 57-6, 57-7, 57-8, 57-9, 57-10, 57-11, 57-12 for carrying the bill to be tested inserted from the insertion hole 50 along the carrying passage 51, magnetic sensor 1 for detecting the magnetic printing portion 22 shown in FIG. 2, and motor 53 for driving worm gears 54-1, 54-2 and worm gears 54-1, 54-2 for transmitting power to the carrying belts 56-1, 56-2.

The operation of this bill discriminating apparatus 100 will now be described.

The bill 20 to be tested inserted from the insertion hole 50 is moved in the direction indicated by arrow and is detected by the entrance sensors 58-1, 58-2 of the optical sensor to start the motor 53 by control means (not shown) on the basis of signal that this entrance sensor 58 outputs. The output shaft of the motor 53 is connected to worm gears 54-1, 54-2 to transmit power of the motor 53 to the pulleys 55-1, 55-3 to rotate the pulley 55-1, 55-3 in a predetermined direction. Moreover, across pulley 55-1 rotated by drive force of the motor 53 and pulley 55-2 disposed in a manner spaced by a predetermined distance, and across pulley 55-3 and pulley 55-4 disposed in a manner spaced by a predetermined distance, carrying belts 56-1 and 56-2 are respectively laid to drive the carrying belts 56-1, 56-2.

Moreover, at the carrying belts 56-1, 56-2, there are provided rollers 57-1, 57-2, 57-3, 57-4, 57-5, 57-6, 57-7, 57-8, 57-9, 57-10, 57-11, 57-12 disposed at predetermined intervals. The roller 57 presses bill to be tested in a manner put therebetween to carry the bill to be tested. The bill to be tested inserted from the insertion hole 50 is moved in the direction indicated by arrow to shortly come to the detection area of the magnetic sensor 1 to further move. The magnetic sensor 1 detects, in a non-contact manner, the magnetic printing portion 22 shown in FIG. 2 formed at moving bill to be tested to output a signal responsive thereto.

(Advantages with the Invention)

As explained above, in accordance with this invention, there is employed such a configuration that thin film flux gate type magnetic sensor is disposed at bill carrying path of bill discriminating unit to detect, in a non-contact manner, on the basis of detection output of this magnetic sensor, at least one of whether a predetermined magnetic printing portion is formed at the inserted bill to be tested and whether there is magnetic reaction (response) from the non-magnetic printing portion. For this reason, locus of detection position is not left at the surface of bill to be tested. As a result, improvement in the security can be made and there is no mechanical abrasion because of non-contact system. Thus, life time of the unit is elongated. In addition, degradation by breakage of bill itself, etc. can be prevented by non-contact system. Thus, reasonable processing of bill can be carried out.

Figure 19:
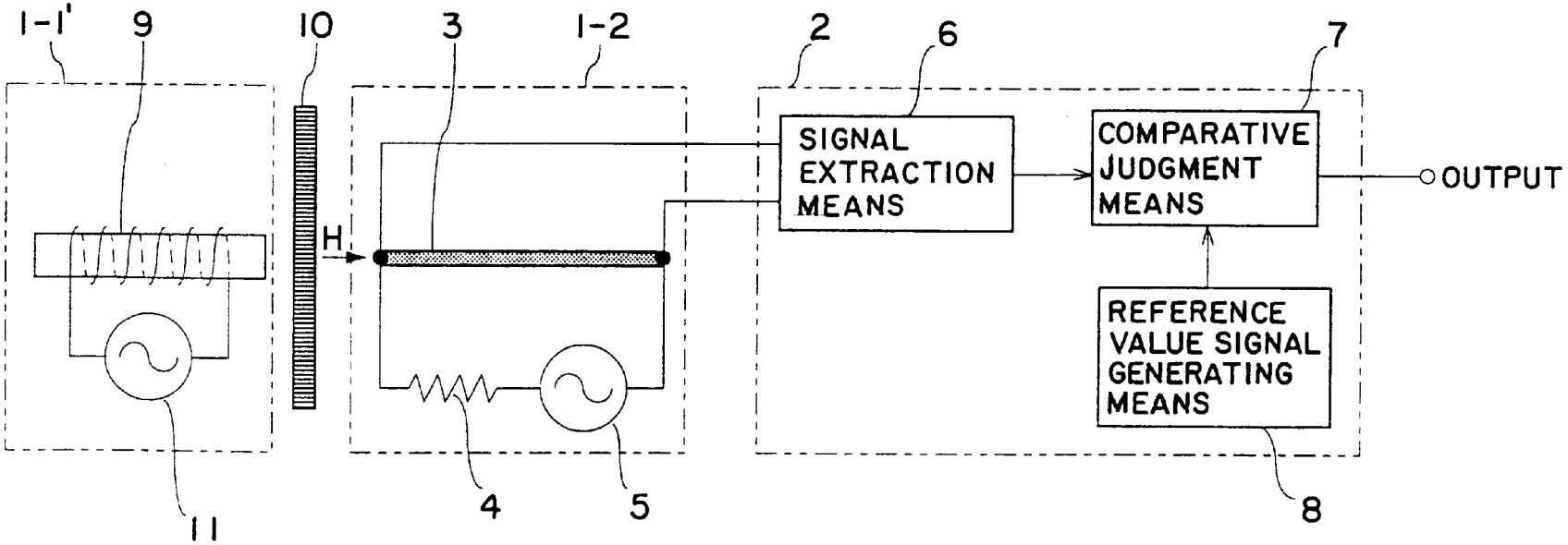
FIG. 19 is a block diagram showing an embodiment of the true/false property testing circuit for coin to be tested according to this invention.

FIG. 19 is a block diagram showing an embodiment of true/false testing property circuit for coin to be tested according to this invention. This true/false property testing circuit for coin is constituted by using computer in practice. In FIG. 19, coin 10 is excited by excitation means 1-1' which outputs a signal within the range of, e.g., several kHz to several hundred kHz, and this excitation state is detected by magnetic detecting means 1-2.

The excitation means 1-1 comprises a signal source 11 and an excitation coil 9 excited by signal from the signal source 11 to excite the coin 10 by magnetic field produced of this excitation coil 9.

The excitation state of the coin 10 excited in this way is detected by magnetic detection means 1-2. This magnetic detection means 1-2 is constituted by using the magnetic inductance type magnetic sensor, and is connected to excitation signal source 5 through current limiting resistor 4 to deliver a detection signal from the coin 10 to signal extraction means 6 at signal processing means 2.

Further, the principle of the magnetic inductance type magnetic sensor is well known from the Japanese Patent Application Laid Open No. 176930/1994 and the Japanese Patent Application Laid Open No. 283344/1994. Namely, this magnetic inductance type magnetic sensor detects, as change by excitation magnetic field, a signal with respect to time change of circumferential magnetic flux produced by allowing high frequency current of, e.g., several MHz to several ten MHz to flow through the magnetic line to output this signal. The sensitivity of this magnetic inductance type magnetic sensor is very high. Thus, sensitivity equal to FG (Flux gate) type magnetic sensor or than that can be obtained.

By using high sensitivity magnetic inductance type magnetic sensor as magnetic detection means in this way, even in the case where coin to be tested indicates fine magnetic change by uneven pattern, etc. attached at its surface, its detection is securely carried out, thus making it possible to form a signal corresponding thereto.

The testing means 2 supplied with a detection signal of the magnetic detection means 1-2 includes comparative judgment means 7 and reference value signal generating means 8 in addition to the signal extraction means 6, and serves to form an output signal corresponding to detection signal of the magnetic detection means 1-2.

Moreover, the magnetic detection means 1-2 can utilize impedance change with respect to excitation magnetic field. In the magnetic inductance type magnetic sensor having such features, utilization of very weak magnetic field measurement, etc. is proposed as high sensitivity magnetic sensor operative at a room temperature.

Figure 20:
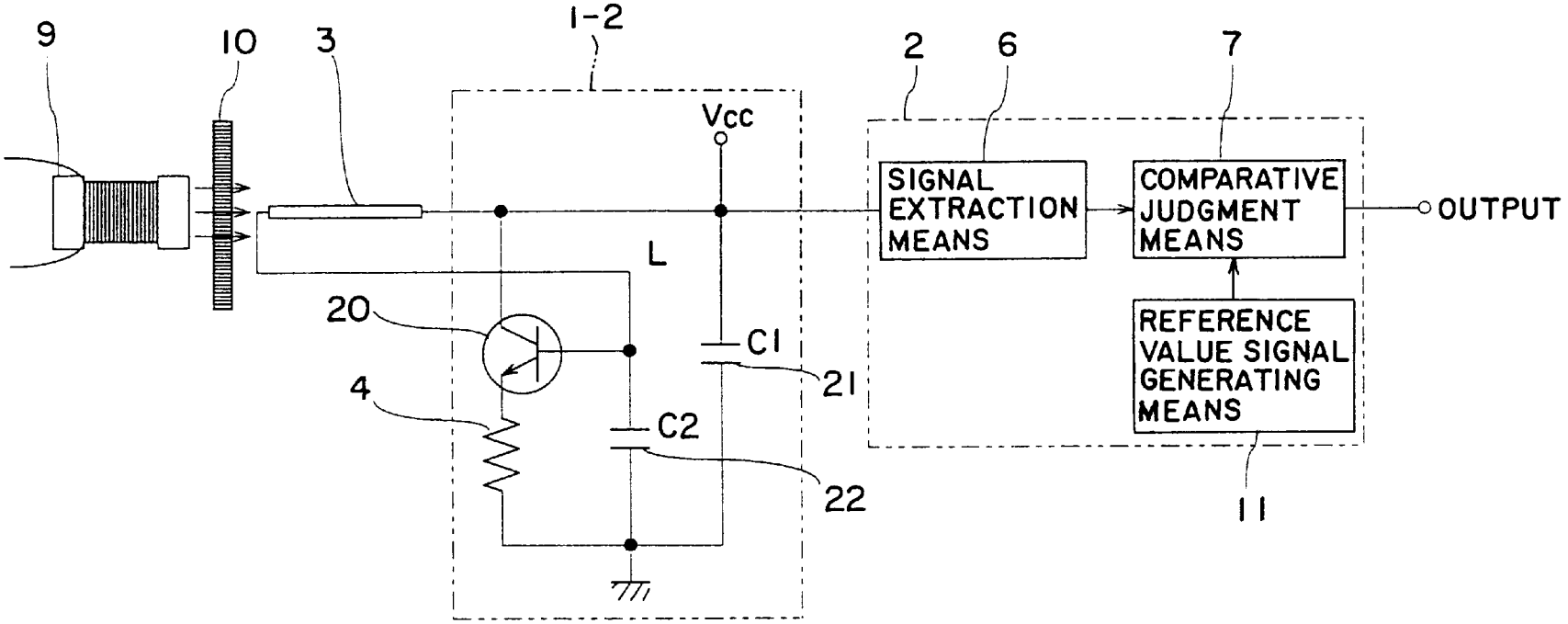
FIG. 20 is a circuit diagram showing the configuration of magnetic detection means 1–2 in the embodiment of FIG. 1.

FIG. 20 shows a detailed configuration of the magnetic detection means 1-2 in the embodiment of FIG. 19.

Namely, the circuit configuration of excitation signal source 5 in the embodiment of FIG. 19 is shown and magnetic line 3 is used as the circuit element of the Colpitts oscillating circuit in this example.

Magnetic line 3 is connected between base and collector of transistor 20 constituting the Colpitts type oscillating circuit. Base is grounded by a capacitor 22. Collector is connected to power supply Vcc, and is grounded by a capacitor 21. Emitter is grounded through a resistor 4. In addition, the collector is connected to the signal extraction means 6 of the testing means 2.

Thus, when the coin 10 is excited by magnetic field produced of the excitation coil 9, the excitation state is detected by the magnetic sensor 3 and the magnetic sensor 3 thus indicates inductance corresponding to the detected excitation state. As a result, oscillating frequency is changed in dependency upon inductance that the magnetic sensor 3 assembled as the circuit element indicates. A signal that this Colpitts oscillating circuit produces is delivered to comparative judgment means 7 through signal extraction means 6 of the signal processing means 2, and is caused to undergo comparative judgment with respect to reference value signal from the reference value signal generating means 8. Thus, truth or false of coin can be recognized. Further, judgment result is outputted to external unit (not shown) from output terminal.

The oscillating frequency of the self-oscillating type circuit constituted as shown in FIG. 20 is determined by inductance of the magnetic line 3, and capacitance values of capacitor 21 (C1) and capacitor 22 (C2), and can be determined by the following formula. In an actual circuit, these circuit constants are values including inductance component and stray capacitance of lead lines 52-1 and 52-2 (see FIGS. 23*a* and *b*) to be connected, etc.

Figure 21:
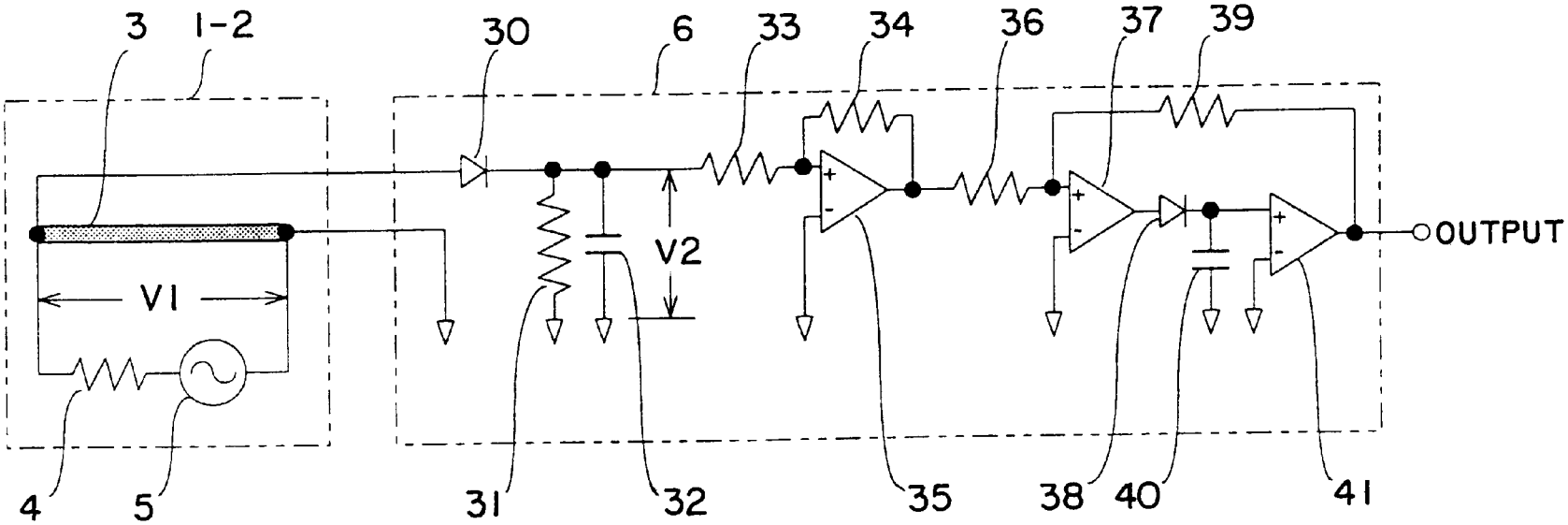
FIG. 21 is a circuit diagram showing the configuration of signal extraction means in the embodiment of FIG. 1.

FIG. 21 shows the detail of internal circuit of the signal extraction means 6 in the embodiment of FIGS. 19 and 20. This signal extraction means 6 includes detection circuit, amplifier circuit and peak hold circuit. Further, the detection circuit is constituted by a diode 30, a resistor 31 and a capacitor 32, and the amplifier (amplification) circuit is constituted by an operational amplifier 35, and resistors 33 and 34. The peak hold circuit is constituted by operational amplifiers 37 and 41, a resistor 36, a diode 38 and a capacitor 40.

Output of the magnetic detection means 1-2 is changed into d.c. output by the detection circuit, and amplitude is increased (amplified) by the amplifying circuit. Thus, peak value is detected by the peak hold circuit. This peak value represents features of coin to be tested and is compared with reference value signal from the reference value signal generating means 8 at the comparative judgment means 7.

While, in the embodiment of FIGS. 19 to 21, coin to be tested is excited by excitation means, there may be employed a configuration in which magnetic characteristic that the coin itself has is detected by magnetic detection means 1-2 without providing this excitation means. As the configuration in that case, there is employed a configuration of the related portion of magnetic detection means 1-2 and signal extraction means 6 shown in FIG. 21 in which excitation means 1-1 is omitted and the portions succeeding thereto.

Figure 22A:
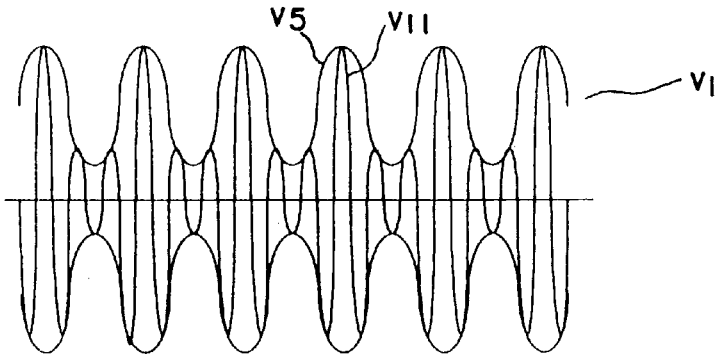
FIGS. 22*a*, 22*b* and 22*c* are views showing signal waveforms of the circuit respective portions of FIG. 21.
Figure 22B:
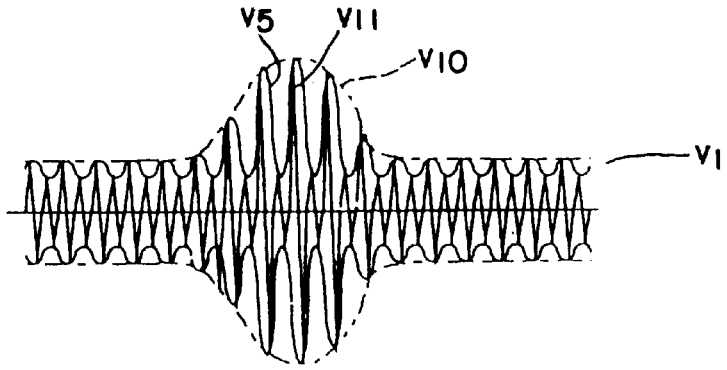
Figure 22C:
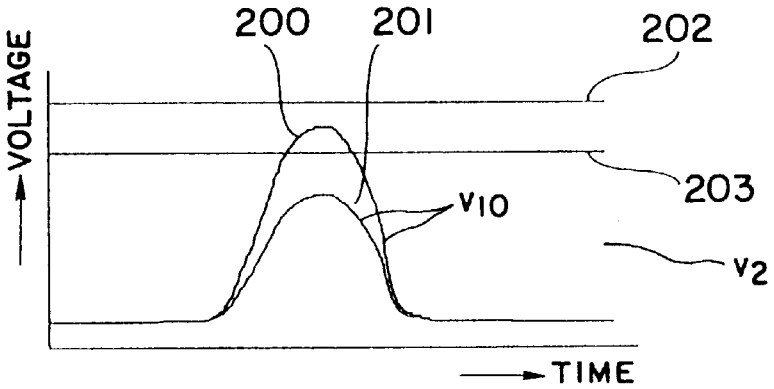

FIGS. 22*a*, 22*b* and 22*c* show two kinds of detection signals of the magnetic sensor and output of the detection circuit in the circuit of FIG. 21. Among them, FIG. 22*a* is depicted in the state where the time axis is extended, and FIGS. 22*b* and 22*c* are depicted on the same time axis.

Initially, FIG. 22*a* shows waveform of detection signal V1 of magnetic sensor 1-2 when coin is not passed, and excitation signal delivered from the signal source 11 (FIG. 19) to the coin 10 is caused to be v5. Excitation signal delivered from excitation signal source 5 to magnetic line 3 is caused to be v11. As previously described, the excitation signal v5 has a frequency within the range of, e.g., several kHz to several hundred kHz and the excitation signal v11 has a frequency within the range of, e.g., several MHz to several ten MHz. Further, the excitation signal v11 has a waveform which is amplitude-modulated by the excitation signal v5.

Further, FIG. 22*b* shows the state where the time axis is compressed into 1/several as compared to FIG. 22*a*, and indicates waveform of detection signal V1 of the magnetic sensor 1-2 when the coin is passed, and signal v10 produced as the result of passage of the coin 10 indicates a waveform having the portion of large amplitude indicating that the coin is passed. Further, this envelope is used as a detection signal.

Finally, FIG. 22*c* shows waveform obtained by detecting signal of FIG. 22*b* to take out only the + side component. Signal 200 of large amplitude and signal 201 of small amplitude are shown by difference between magnetic characteristics of two coins which have been passed. The small amplitude signal 201 does not exceed any judgment value, whereas the large amplitude signal 200 exceeds the judgment value 203, but does not exceed higher judgment value 202. By such difference between signal levels, it is possible to carry out judgment for true/false property discrimination of coin to be tested.

Figure 23A:
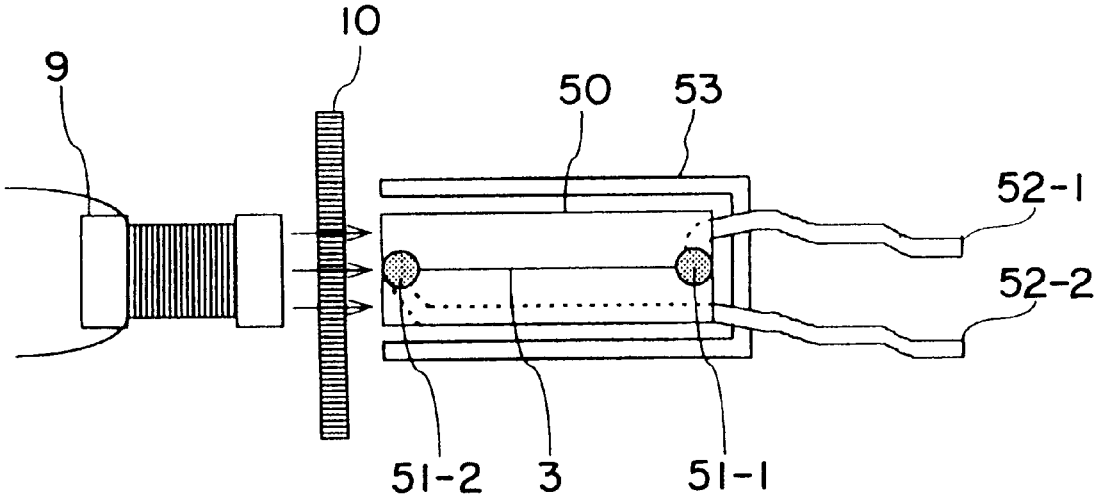
FIG. 23*a* is a view showing an example of the configuration of the magnetic inductance type magnetic sensor used in the embodiment of FIG. 19.
Figure 23B:
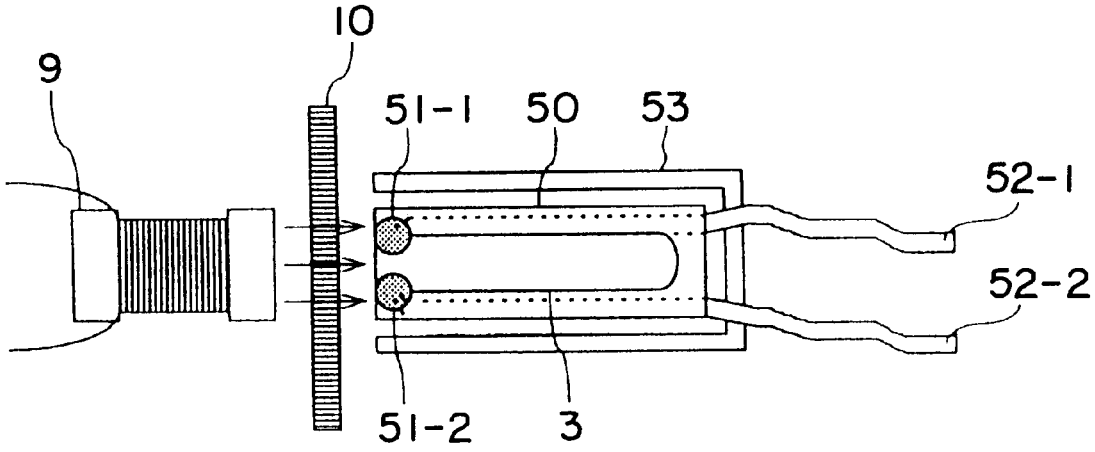
FIG. 23*b* is a view similarly showing another example of the configuration thereof.

FIGS. 23*a* and 23*b* show an example of the configuration of the magnetic inductance type magnetic sensor. In FIGS. 23*a* and 23*b*, the magnetic line 3 constitutes magnetic inductance element, and fine wire such as amorphous metal of high permeability, etc. is used. Further, in the case of FIG. 23*a*, the magnetic line 3 is bonded in such a manner to electrically conduct terminals 51-1 and 51-2 provided at both ends of a printed board 50, and are connected to lead lines 52-1 and 52-2. Moreover, in the case of FIG. 23*b*, the magnetic line 3 is provided so as to take U-shape between terminals 51-1 and 51-2 provided at one end of the printed board 50, and both ends are bonded in such a manner to electrically conduct the terminals 51-1 and 51-2, and are connected to lead lines 52-1 and 52-2. Further, in both cases of FIGS. 23*a* and 23*b*, there is employed a configuration in which excitation coil 9 is provided in a manner opposite to the end portion of the magnetic inductance type magnetic sensor, and the coin is caused to be passed through the portion between this excitation coil and the magnetic inductance type magnetic sensor.

The magnetic inductance type magnetic detection means 1-2 is adapted to surround, by the magnetic shield 53, the surface except for the surface opposite to the coin 10 to be tested, thus making it possible to prevent magnetic disturbance to improve the detection accuracy. This magnetic shield 53 can interrupt leakage magnetic flux produced from power source of the coin discriminating unit (not shown), etc. As a result, S/N ratio of signal detected from the magnetic detection means 1-2 is improved so that the detection accuracy is improved.

Figure 24:
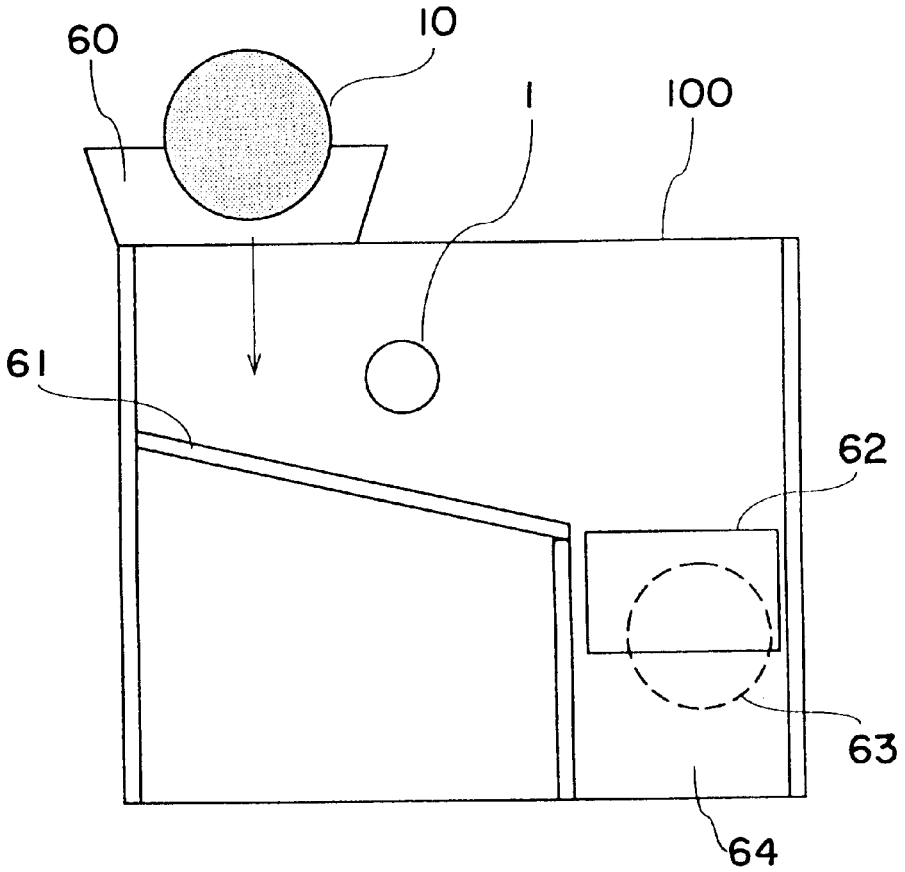
FIG. 24 is an explanatory view showing installation state of magnetic sensor with respect to coin mechanism to be applied to this invention.

FIG. 24 shows installation state of coin mechanism 100 to be applied to this invention, and magnetic inductance type magnetic sensor 1 with respect thereto. The coin mechanism 100 serves to guide coin 10 via a throwing hole 60, a rail 61 and a gate 62 to carry out sorting (distribution) by magnetic absorption by a solenoid coil 63 to eject coin from a true coin ejection hole 64. Further, the magnetic inductance type magnetic sensor 1 is provided at the middle position of the rail 61. As shown in FIG. 24, since the magnetic inductance type magnetic sensor 1 is compact, even in the case of device small in space like coin mechanism provided (installed) within the automatic vending machine, it is possible to easily assemble it.

Figure 25:
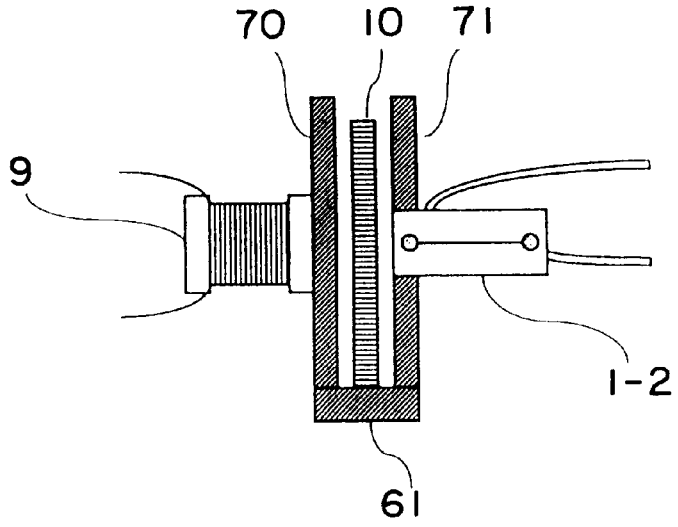
FIG. 25 is an explanatory view showing installation state of excitation coil and magnetic sensor in the coin mechanism of FIG. 24.

FIG. 25 shows the structural relationship between the rail 61 and the magnetic inductance type magnetic sensor 1 in the coin mechanism 100 as cross section of the state viewed from the lower side in length direction of the rail 61. As shown in FIG. 25, at upper portion both sides of the rail 61, side walls 70, 71 are provided to form slide down path of groove shaped coin 10 along with the rail 61. At the outside surface of the side wall 70, excitation coil 9 is provided. In addition, magnetic inductance type magnetic sensor 1 is provided in a manner penetrated through the central portion of the side wall 71.

(Other embodiments)

While, in the above-mentioned embodiment, peak value, i.e., maximum value detected from the coin is compared with reference value to carry out true/false test, minimum value may be utilized in addition to the above. Further, e.g., pattern signal obtained by scanning diameter position of coin may be detected to compare it with reference pattern signal set in advance.

While colpitts type oscillating circuit is shown as an example of the oscillating circuit in the above-mentioned embodiment, this oscillating circuit may be replaced by Hartley type oscillating circuit, clamping type oscillating circuit, or Lampkin type oscillating circuit.

(Advantages with the invention)

In accordance with this invention, as described above, it is possible to precisely detect even change of very small (delicate) magnetic characteristic resulting from fine shape change of the coin surface on the basis of the principle of high sensitivity magnetic inductance type magnetic sensor. Further, in accordance with this invention, since the magnetic characteristic of coin is detected by using the magnetic inductance type magnetic sensor which can be constituted to be compact, it is possible to easily provide it at the unit in which only small installation capacity can be obtained like coin mechanism. As a result, it is possible to provide a device capable of precisely detecting true/false property of coin while being compact.

Figure 26:
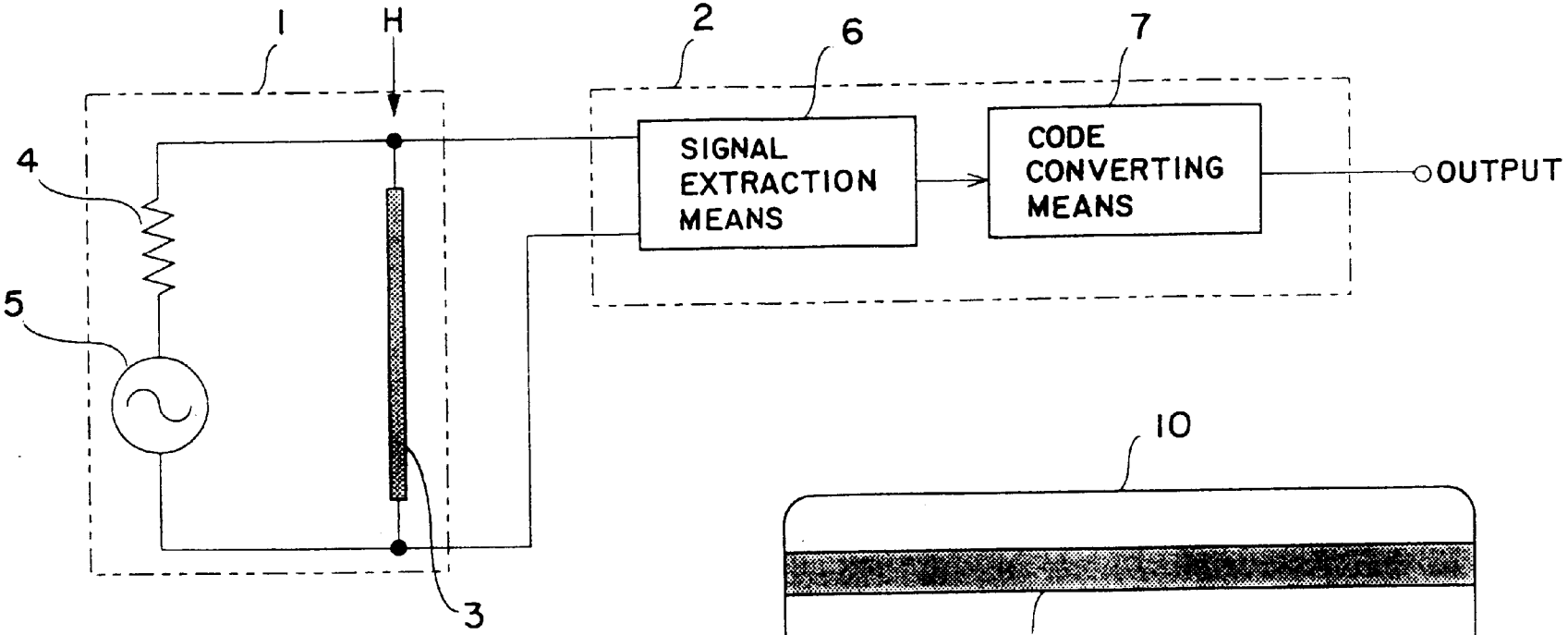
FIG. 26 is a block diagram showing a still further embodiment of an information reading circuit of this invention.

FIG. 26 relates to an apparatus for reading information on the magnetic card, and is a block diagram showing one embodiment of a reading circuit for information according to this invention. This reading circuit is constituted by using computer in practice.

Figure 27:
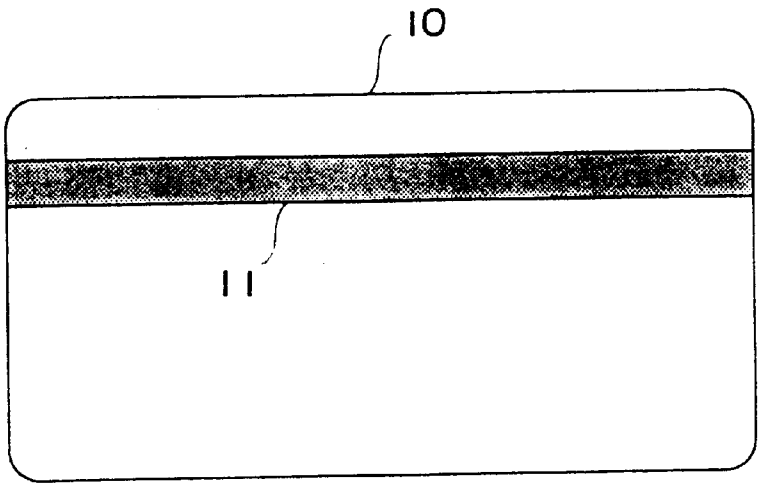
FIG. 27 is a view showing an example of the configuration of magnetic card used in the embodiment of FIG. 26.

FIG. 27 shows an example of the configuration of magnetic card 10 used in this embodiment. In FIG. 27, the magnetic card 10 is adapted so that magnetic stripe portion (magnetic recording area) 11 is formed at its surface. In this case, recording of information with respect to the magnetic stripe portion 11 formed on the surface of the magnetic card 10 is carried out by scanning the magnetic card 10 by using magnetic head (not shown). Thus, data having a predetermined magnetization pattern is recorded at the magnetic stripe portion 11.

Returning to FIG. 26 for a second time, the magnetic sensor 1 is constituted by the magnetic inductance type magnetic sensor. The operation principle of this magnetic inductance type magnetic sensor is known by the Japanese Patent Application Laid Open No. 176930/1994 and the Japanese Patent Application Laid Open No. 283344/1994. Namely, the magnetic inductance type magnetic sensor used in this embodiment detects, as change by externally applied magnetic field H, voltage with respect to time change of circumferential magnetic flux produced by allowing high frequency current to flow through the magnetic line to output it. The sensitivity of the magnetic inductance type magnetic sensor is very high. Sensitivity equal to the FG (flux gate) type magnetic sensor or more than that can be obtained.

Further, detection signal of the magnetic sensor 1 is delivered to signal formation means 2. The signal formation means 2 includes signal extraction means 6 and code converting means 7, and serves to form an output signal corresponding to detection signal of the magnetic sensor 1.

Moreover, the magnetic inductance type magnetic sensor 1 utilizes change of inductance or impedance with respect to externally applied magnetic field. With respect to the magnetic inductance type magnetic sensor having such features, utilization to measurement of very weak magnetic field, etc. is proposed as high sensitivity magnetic sensor operative at a room temperature.

Figure 28:
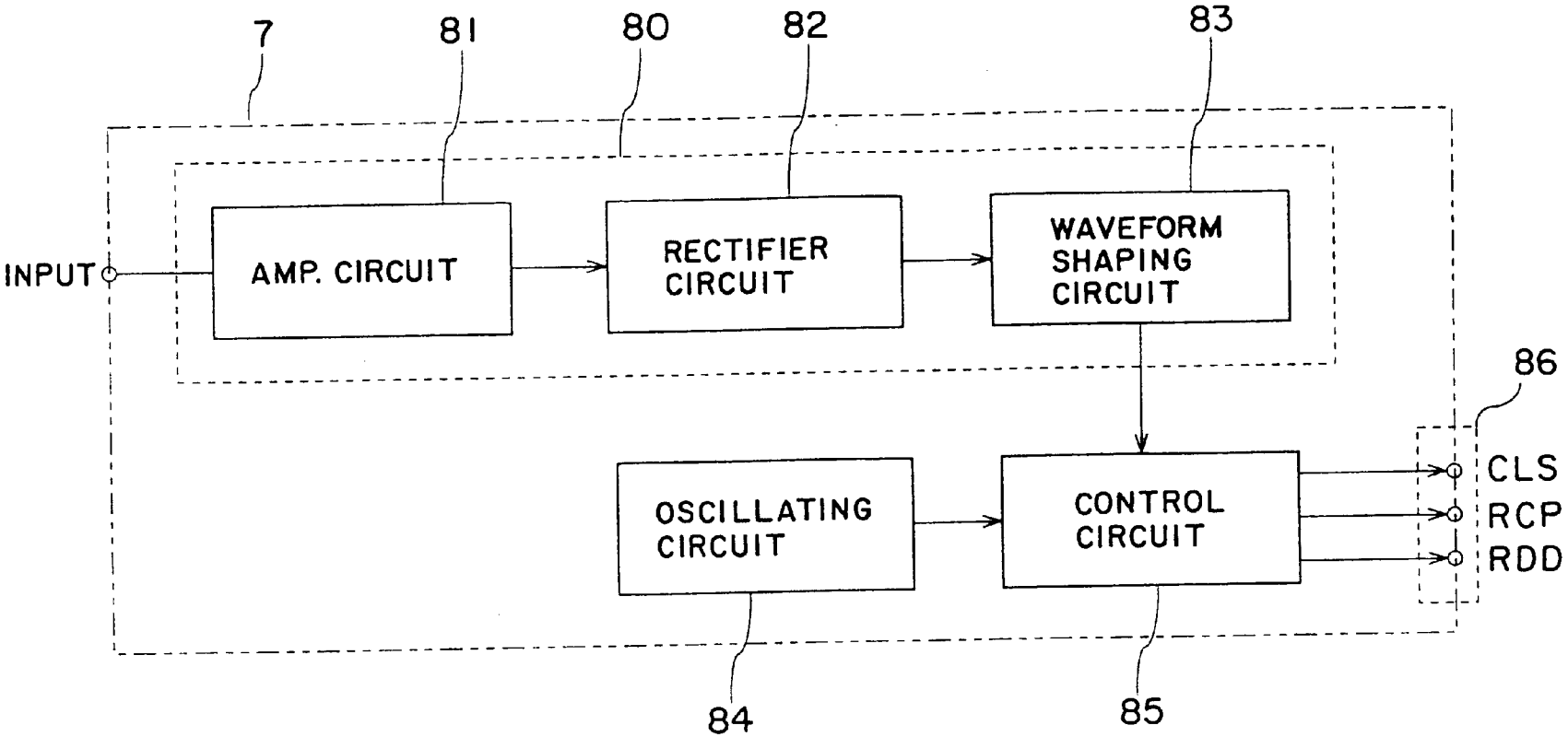
FIG. 28 is a block diagram showing the detail of circuit configuration of the embodiment shown in FIG. 1.

FIG. 28 is a block diagram showing an example of the configuration of this code converting means 7. In FIG. 28, the code converting means 7 first delivers a signal from signal extraction means 6 to an amplifier (amplification) circuit 81 of a demodulating circuit 80. This demodulating circuit 80 is called F2F (system) demodulating circuit. This F2F is called frequency modulation system and is generalized as the recording system when information is recorded with respect to magnetic stripe portion 11 of magnetic card 10.

The demodulating circuit 80 is a circuit for converting an analog signal obtained by scanning the magnetic stripe portion 11 of the magnetic card 10 by magnetic sensor 1 into digital code.

Figure 29:
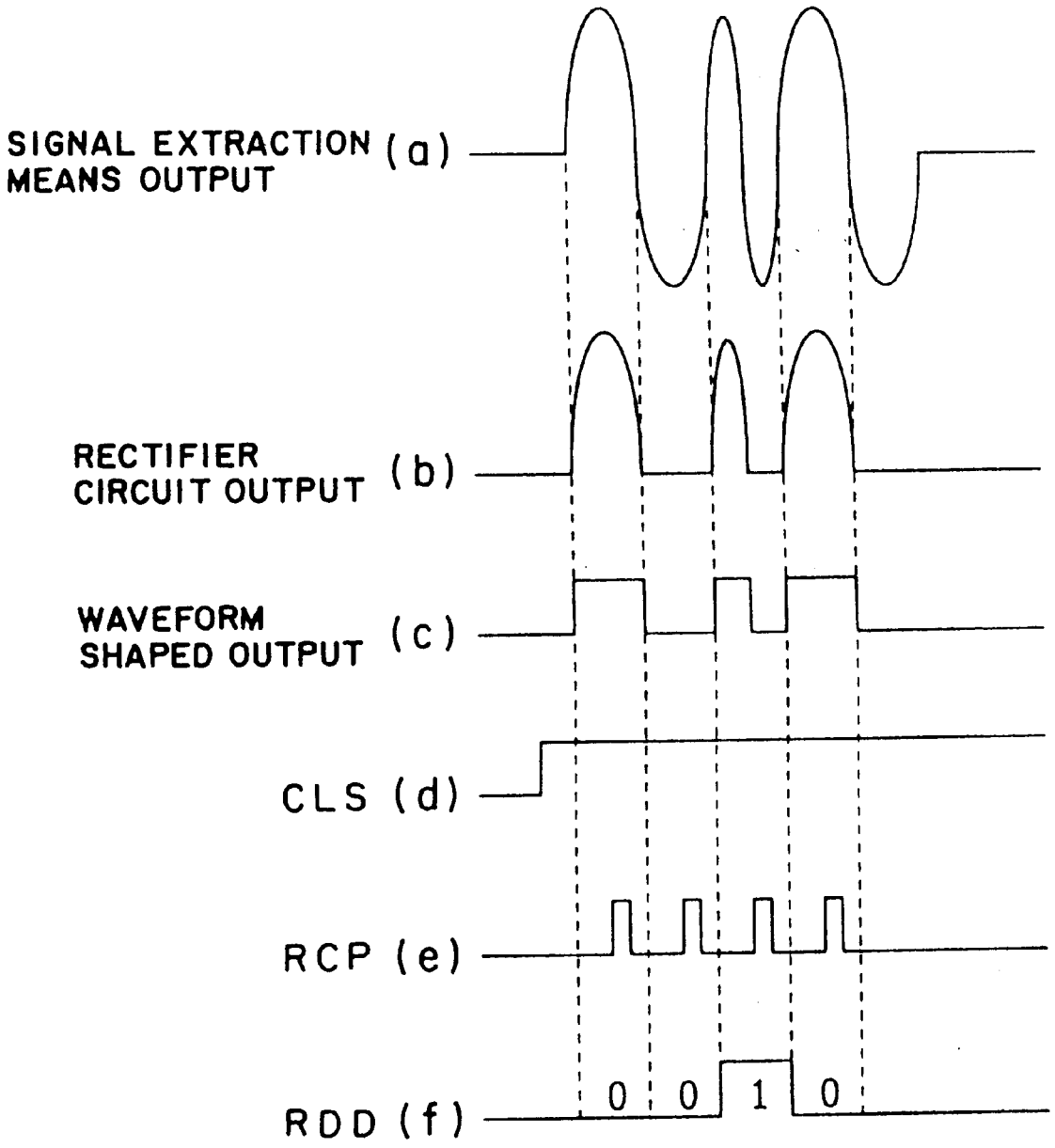
FIG. 29 is a view showing signal waveforms of circuit respective portions of the embodiment shown in FIG. 28.

FIG. 29 shows the operation of the code converting means 7. A signal inputted to the amplifier circuit 81 is shown in FIG. 29(*a*), and is a.c. signal outputted from the signal extraction means 6 shown in FIG. 26. The signal inputted to the amplifier circuit 81 is inputted to a rectifier circuit 82 after undergone amplification. The rectifier circuit 82 extracts a signal of the upper side of a.c. signal, as shown in FIG. 29 (*b*), for example, from the inputted a.c. signal.

An analog signal outputted from the rectifier circuit 82 is converted into a digital signal, as shown in FIG. 29(*c*), by a waveform shaping circuit 83. This digital signal corresponds to the above-described F2F recording system, and is a digital signal such that when frequency for reading "0" of data recorded at the magnetic stripe 11 is assumed to be F, frequency for reading data "1" is doubled (2F).

A signal converted into digital signal by the waveform shaping circuit 83 is inputted to a control circuit 85. On one hand, the control circuit 85 is supplied with clock signal (RCP) of a predetermined period shown in FIG. 29(*e*) outputted from the oscillating circuit 84. Further, the control circuit 85 outputs, to external unit (not shown), signal (RDD) converted into code of "0" or "1" as shown in FIG. 29(*f*) corresponding to information recorded at the magnetic stripe 11 in such a manner that digital signal is caused to be synchronous with clock signal to external unit (not shown).

In this case, the magnetic inductance type magnetic sensor 1 surrounds, by the magnetic shield 33, the surface except for the surface opposite to the magnetic card 10 as shown in FIG. 3 to improve the detection accuracy. This magnetic shield 33 can interrupt leakage magnetic flux produced from power supply of reading unit (not shown) or carrying motor 60 (see FIG. 31) for carrying magnetic card 10, etc. For this reason, S/N ratio of signal detected from the magnetic sensor I is improved. Thus, detection accuracy is improved.

Figure 30:
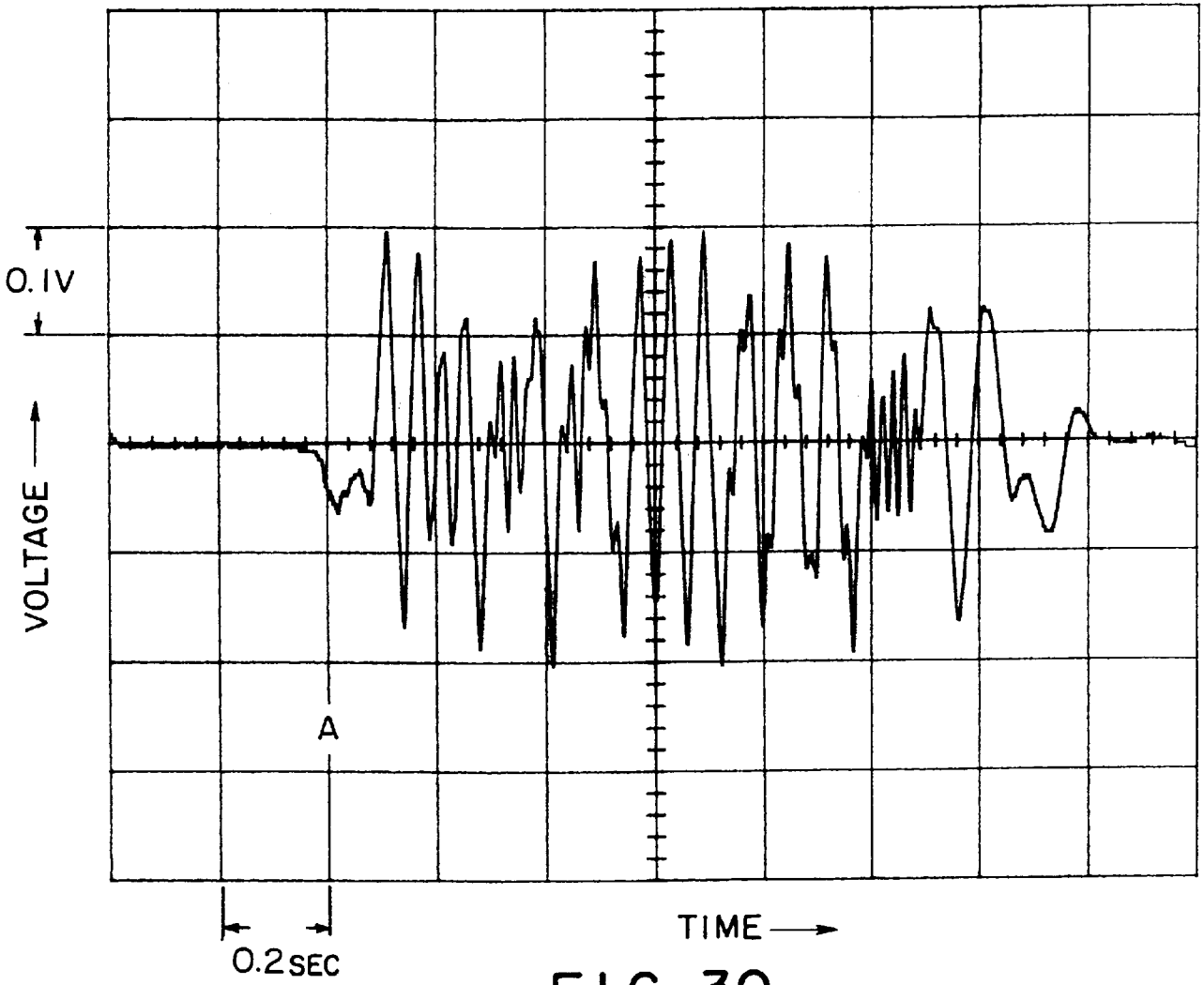
FIG. 30 is a waveform diagram showing output example of the magnetic inductance type magnetic sensor used in the embodiment of FIG. 1.

FIG. 30 shows an example of detection output waveform obtained when the magnetic stripe portion 11 of the magnetic card 10 is scanned by the magnetic inductance type magnetic sensor 1. The magnetic card 10 is carried, and detection output of the magnetic inductance type magnetic sensor 1 starts vibration at position (position of A in the figure) opposite to the magnetic stripe portion 11.

Figure 31:
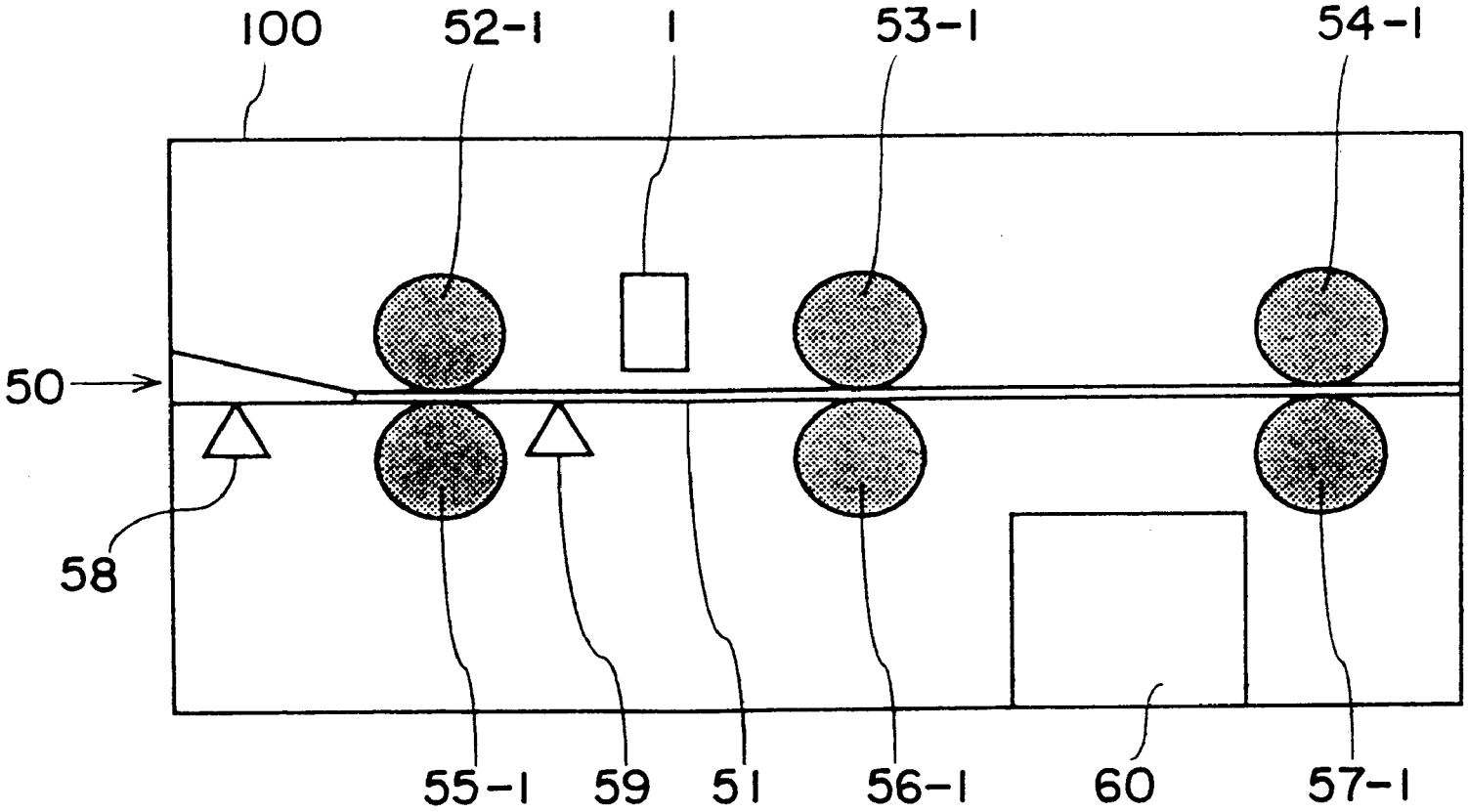
FIG. 31 is a side view showing the mechanism of the embodiment of this invention.
Figure 32:
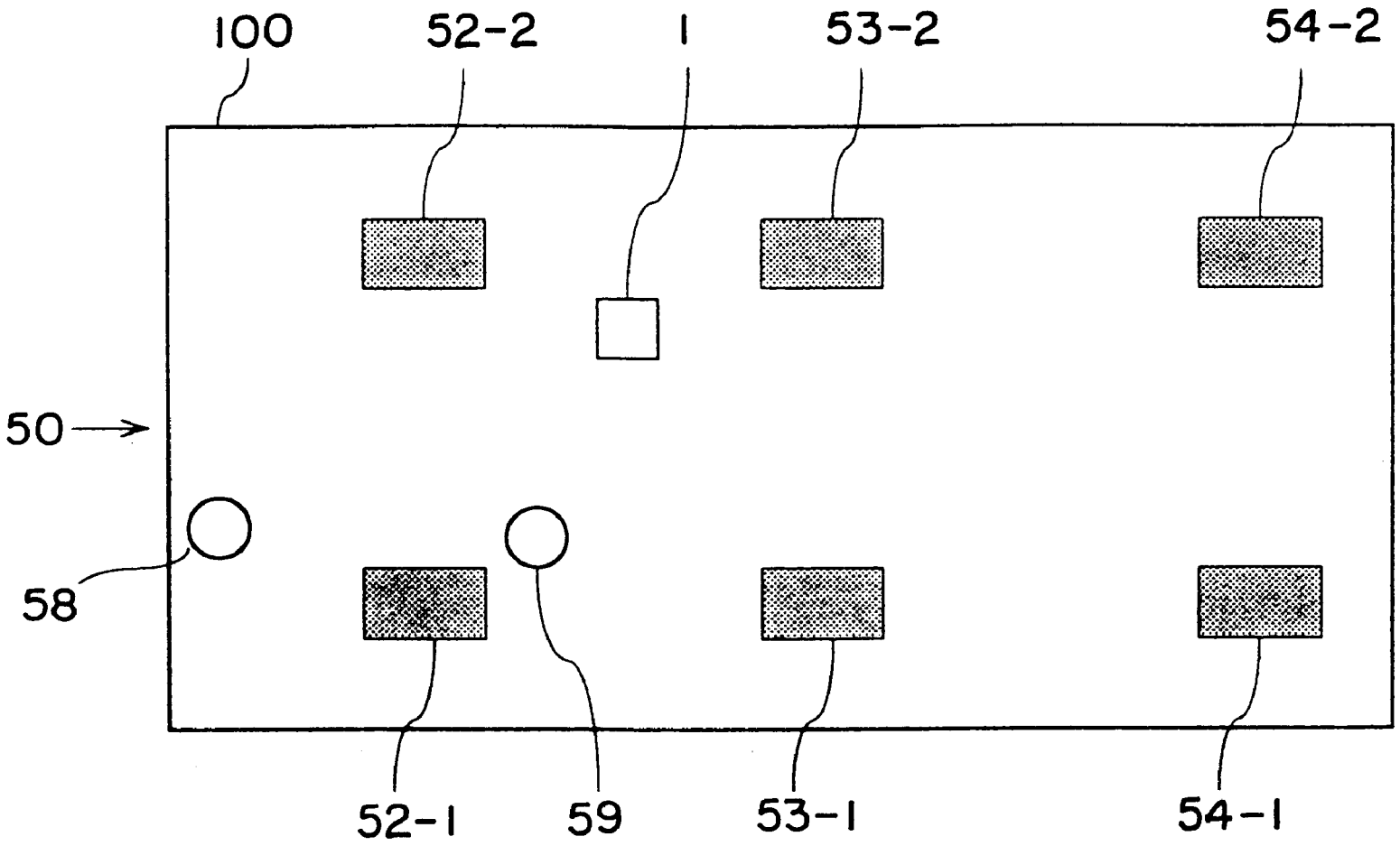
FIG. 32 is a plan view corresponding to FIG. 31 showing the mechanism of the embodiment of this invention.

FIG. 31 is a side view showing outline of the configuration of an embodiment of information reading unit employing the method and the apparatus for reading information recorded on the magnetic card according to this invention, and FIG. 32 is its plan view.

The information reading unit of this embodiment has a mechanism as shown in FIGS. 30 and 31. Namely, this information reading unit is of a structure comprising a card carrying path 51 for guiding magnetic card 10 in the direction indicated by arrow from the card insertion hole 50, an entrance sensor 58 for detecting magnetic card inserted in the direction indicated by arrow from the card insertion hole 50, a position sensor 59 for informing reading start of information recorded at the magnetic stripe portion 11 shown in FIG. 27 formed on the magnetic card 10 carried by carrying rollers 52-1, 52-2, 53-1, 53-2, 54-1, 54-2, 55-1, 55-2, 56-1, 56-2, 57-1, 57-2 which carry the magnetic card 10 inserted from the card insertion hole 50 along the card carrying path 51, magnetic sensor 1 for detecting information recorded on the magnetic stripe portion 11, and carrying motor 60 for driving carrying rollers 52-1 to 57-2.

The operation of the information reading unit 100 of this embodiment will now be described.

The magnetic card 10 inserted from the card insertion hole 50 is moved in the direction indicated by arrow, and is detected by the entrance sensor 58 constituted by, e.g., optical sensor to start the carrying motor 60 by control means (not shown) on the basis of signal that this entrance sensor 58 outputs. By power of the carrying motor 60, carrying rollers 52-1, 52-2, 53-1, 53-2, 54-1, 54-2, 55-1, 55-2, 56-1, 56-2, 57-1, 57-2 are driven through power transmission means, e.g., pulley and belt, etc. (not shown). The carrying rollers 52-1 to 57-2 press the magnetic card 10 in a manner put therebetween to carry the magnetic card 10. The magnetic card 10 inserted from the card insertion hole 50 is moved in the direction indicated by arrow to shortly reach the position sensor 59. As a result, the position sensor 59 outputs a timing signal for starting reading operation with respect to external unit (not shown). The magnetic card 10 further proceeds along the carrying path to move within the detection area of the magnetic sensor 1. The magnetic sensor 1 reads, in a non-contact manner, information recorded on the magnetic stripe portion 11 shown in FIG. 2 formed at the moving magnetic card 10 to output a signal corresponding thereto.

(Other embodiment)

While explanation has been given in connection with the magnetic card in the above-described embodiments, there may be employed similar configuration also with respect to passenger ticket, etc. on which information are recorded by magnetism.

(Advantages with the Invention)

As explained above, in accordance with this invention, since there is employed such configuration that magnetic sensor is disposed at the carrying passage for magnetic card or the like of the recording information reading unit for the magnetic card or the like to read, in a non-contact manner, information recorded at the inserted magnetic card or the like on the basis of detection output of this magnetic sensor, locus of detection position is not left at the surface of the magnetic card or the like so that improvement in the security can be made, and there is no mechanical abrasion because of non-contact system so that life time of the apparatus is elongated. In addition, degradation by breakage, etc. of the magnetic card or the like can be prevented, thus making it possible to read, with high accuracy, recording information of the magnetic card or the like.

What is claimed is:

1. An apparatus for testing true/false property of a bill to be tested in a non-contact manner, comprising:

a non-contact magnetic inductance type magnetic sensor disposed, at a predetermined position of a carrying path of the bill, in a manner close to the carrying path, wherein the magnetic inductance type magnetic sensor includes a magnetic line of a high permeability fine wire, at lease a portion of which being disposed perpendicular to a surface of the bill to be tested and a support structure for supporting said magnetic line; and testing means for testing true/false property of the bill on the basis of a signal outputted from the magnetic sensor as the bill is carried along the carrying path.

2. An apparatus of claim 1, wherein said magnetic line is a high permeability amorphous fine wire.

3. An apparatus of claim 1, wherein said magnetic line is straight and disposed perpendicular to a surface of the bill to be tested.

4. An apparatus of claim 1, wherein said magnetic line is a U-shaped fine wire, two ends of the U-shaped wire facing a surface of the bill to be tested and two straight portions disposed perpendicular to the surface of the bill.

* * * * *